US008690282B2

(12) United States Patent
Hagiwara et al.

(10) Patent No.: US 8,690,282 B2
(45) Date of Patent: Apr. 8, 2014

(54) LIQUID EJECTING APPARATUS

(75) Inventors: Hiroyuki Hagiwara, Nagano (JP); Yasushi Yajima, Minowa-machi (JP); Norihito Harada, Azumino (JP); Daisuke Hiruma, Nagano (JP); Ryo Hamano, Nagano (JP); Hiroyuki Ishii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 160 days.

(21) Appl. No.: 13/315,446

(22) Filed: Dec. 9, 2011

(65) Prior Publication Data

US 2012/0147076 A1 Jun. 14, 2012

(30) Foreign Application Priority Data

Dec. 10, 2010 (JP) ..... 2010-275452

(51) Int. Cl.
*B41J 29/38* (2006.01)

(52) U.S. Cl.
USPC ..... 347/10; 347/19

(58) Field of Classification Search
USPC ..... 347/5–20, 40–43
IPC ..... B41J 29/38
See application file for complete search history.

(56) References Cited

U.S. PATENT DOCUMENTS

| | | | | |
|---|---|---|---|---|
| 5,847,722 | A * | 12/1998 | Hackleman | 347/19 |
| 6,053,597 | A * | 4/2000 | Hirota | 347/19 |
| 6,390,590 | B1 * | 5/2002 | Hansburg | 347/19 |
| 6,478,399 | B1 * | 11/2002 | Mitsuzawa et al. | 347/19 |
| 2005/0248627 | A1 * | 11/2005 | Ito et al. | 347/71 |

FOREIGN PATENT DOCUMENTS

| | | |
|---|---|---|
| JP | 2002-337348 | 11/2002 |

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid ejecting apparatus includes a liquid ejecting head unit including a plurality of liquid ejecting heads in a parallel arrangement. Each liquid ejecting head ejects a liquid from nozzles formed in a nozzle face toward an ejection target object in accordance with a drive signal from a controller. Each liquid ejecting head has an individual two-dimensional code that includes at least a portion of information related to the liquid ejecting head. The liquid ejecting head unit includes a collective two-dimensional code that includes arrangement information of the liquid ejecting heads in the liquid ejecting head unit and collective information related to the information included in the individual two-dimensional codes.

8 Claims, 17 Drawing Sheets

LIQUID EJECTING APPARATUS

The entire disclosure of Japanese Patent Application No: 2010-275452, filed Dec. 10, 2010 is expressly incorporated by reference herein.

BACKGROUND

1. Technical Field

The present invention relates to a liquid ejecting apparatus, such as an ink jet printer, equipped with liquid ejecting heads that cause pressure fluctuation to occur in pressure chambers communicating with nozzles so as to eject a liquid within the pressure chambers from the nozzles.

2. Related Art

A liquid ejecting apparatus generally includes liquid ejecting heads that can eject a liquid as liquid droplets, and can eject various kinds of liquids from the liquid ejecting heads. A representative example of a liquid ejecting apparatus is an image recording apparatus, such as an ink jet recording apparatus (printer) that has ink jet recording heads (referred to as "recording heads" hereinafter) and that performs recording by ejecting liquid ink as ink droplets from nozzles of the recording heads. In recent years, liquid ejecting apparatuses are not limited to image recording apparatuses, but are also applied to various types of manufacturing apparatuses, such as display manufacturing apparatuses. Recording heads for an image recording apparatus are configured to eject liquid ink. Colorant ejecting heads for a display manufacturing apparatus are configured to eject red (R), green (G), and blue (B) colorant solutions. Electrode-material ejecting heads for an electrode manufacturing apparatus are configured to eject a liquid electrode material. Bioorganic ejecting heads for a chip manufacturing apparatus are configured to eject a bioorganic solution.

With regard to such printers in recent years, improvements in ink ejection properties are demanded so as to allow for higher image quality. In particular, the ink ejection properties (e.g., the amount and the traveling speed of ink ejected from the nozzles) sometimes vary among the recording heads due to a production variation in the recording heads. For this reason, after the production of each recording head, a two-dimensional code including an optimal parameter value, such as a drive voltage, required for generating a drive signal for driving a pressure generator of the recording head is bonded to the recording head. After the recording head is attached to the printer body, the value of the two-dimensional code is read, and the value is written into a built-in nonvolatile memory in the printer. When the printer performs ejecting operation, a drive signal is generated on the basis of the optimal value written in the nonvolatile memory. JP-A-2002-337348 proposes an example of such a printer. Accordingly, optimal ink ejection properties can be obtained for each recording head, thereby providing a printer with high image quality.

A single head unit having multiple recording heads that are arranged in and fixed to a head fixing member, such as a sub carriage, is known. Regarding a printer equipped with such a head unit, in a state where the head unit is accommodated in an outer shell member, such as a casing, it is sometimes difficult to individually read the two-dimensional codes of the recording heads, as compared with a case where there is only one recording head. For example, in the case where the recording heads are arranged adjacent to each other in the scanning direction, if the two-dimensional codes are bonded to surfaces of the recording heads that are parallel to the scanning direction, the two-dimensional code of one recording head cannot be read because the recording head is blocked by the adjacent recording heads. If the two-dimensional codes are bonded to surfaces (front surfaces or rear surfaces) of the recording heads that are perpendicular to the scanning direction, it is difficult to read the two-dimensional codes since the recording heads are blocked by the frame of the printer or the aforementioned outer shell member.

SUMMARY

An advantage of some aspects of the invention is that a liquid ejecting apparatus that can readily and reliably read information related to each of liquid ejecting heads included in a liquid ejecting head unit is provided.

According to an aspect of the invention, a liquid ejecting apparatus includes a liquid ejecting head unit including a plurality of liquid ejecting heads in a parallel arrangement. Each liquid ejecting head ejects a liquid from nozzles formed in a nozzle face toward an ejection target object in accordance with a drive signal from a controller. Each of the liquid ejecting heads has an individual two-dimensional code that includes at least a portion of information related to the liquid ejecting head. The liquid ejecting head unit includes a collective two-dimensional code that includes arrangement information of the liquid ejecting heads in the liquid ejecting head unit and collective information related to the information included in the individual two-dimensional codes.

With this configuration, since the liquid ejecting head unit has the collective two-dimensional code that collectively includes the information of the liquid ejecting heads, the information of the liquid ejecting heads can be readily and reliably read, regardless of the mounting positions of the liquid ejecting heads, by setting this collective two-dimensional code in advance at a readily readable location. Therefore, optimal control can be performed for each liquid ejecting head on the basis of the read information. In other words, an optimal drive signal can be set for each liquid ejecting head. Furthermore, since the information of each liquid ejecting head can be obtained by reading a single code, a human error, such as accidentally reading a neighboring code, can be prevented, thereby ensuring the correspondence relationship between the read information and the liquid ejecting head. The expression "collective information related to the information included in the individual two-dimensional codes" refers to a group of information included in the individual two-dimensional codes or relevant information with which the contents of the information in the individual two-dimensional codes (e.g., encrypted information of the individual two-dimensional codes) can be ascertained.

In the above configuration, each of the liquid ejecting heads preferably has a plurality of nozzle arrays provided with the nozzles, and a pressure generator that generates pressure fluctuation in the liquid within a pressure chamber communicating with the nozzles. In this case, the drive signal preferably includes a drive pulse that drives the pressure generator so as to eject the liquid from the nozzles. Moreover, the information related to the liquid ejecting head preferably includes at least one of drive voltage information of the drive pulse, natural vibration period information of pressure vibration occurring in the liquid in the pressure chamber, liquid-amount identification information indicating a variation in the amount of the liquid ejected from the nozzles in each nozzle array, and frequency characteristic information related to the amount or the traveling speed of the liquid ejected from the nozzles by repeatedly applying the drive pulse to the pressure generator.

In the above configuration, in addition to the arrangement information and the collective information, the collective two-dimensional code preferably includes information related to alignment of each liquid ejecting head in the liquid ejecting head unit.

With this configuration, in addition to the information about each liquid ejecting head itself, the information related to the alignment in the liquid ejecting head, such as positional displacement of the nozzles in the liquid ejecting head, can also be recorded. Therefore, by reading the information during the manufacturing process of the liquid ejecting apparatus, more optimal control can be performed in view of the information related to the alignment in each liquid ejecting head, in addition to the information about the liquid ejecting head itself. Specifically, by adjusting the liquid ejection timing of each liquid ejecting head on the basis of the read alignment information, deviations in the liquid landing positions on the ejection target object can be reduced.

In the above configuration, the information related to the alignment preferably includes at least one of the inclination of the nozzle face of each liquid ejecting head in the liquid ejecting head unit, the height of the nozzle face from a head-unit reference surface, the relative position or the inclination of the nozzles, liquid-droplet-amount information, and information related to liquid-droplet traveling speed.

With this configuration, with regard to an ejection timing adjustment process performed for the liquid ejecting heads after joining the liquid ejecting head unit to the liquid ejecting apparatus, the time required for the adjustment process can be shortened, as compared with, for example, a method in which the ejection timing (drive-waveform generation timing) of the liquid ejecting heads is adjusted on the basis of a liquid-landing result obtained when the liquid ejected from the nozzles of the liquid ejecting heads land on the ejection target object. Specifically, an optimal timing can be calculated in advance on the basis of the inclination of the nozzle face of each liquid ejecting head, the height of the nozzle face from the head-unit reference surface (i.e., the reference attachment position of the liquid ejecting head relative to the liquid ejecting head unit), the relative position or the inclination of the nozzles (i.e., the inclination of straight portions of the nozzles), the liquid-droplet-amount information, or the information related to liquid-droplet traveling speed. By performing liquid ejection control on the basis of this timing, deviations in the liquid landing positions can be reduced. This substantially eliminates the need for performing the aforementioned adjustment process based on the liquid-landing result or shortens the time required for the adjustment process. In particular, when the liquid ejecting head unit is to be replaced in the user's usage environment at the time of an after-sales service, the time period from the replacement to the adjustment can be shortened, thereby advantageously increasing the availability of the liquid ejecting apparatus for the user.

In the above configuration, it is preferable that the liquid ejecting apparatus further include a casing member accommodating the liquid ejecting head unit therein. In this case, the casing member is preferably provided with an opening that exposes the nozzle faces and a window located at a position facing the collective two-dimensional code and extending through the casing member in a thickness direction thereof, and is also preferably provided with a detachable cover member that covers the window at a front face of the window.

With this configuration, the cover member can be attached to the window when the collective two-dimensional code is not being read, thereby protecting the liquid ejecting head unit. In particular, mist created during liquid ejection can be prevented from entering the casing member. This not only prevents a state where the collective two-dimensional code becomes dirty and unreadable due to the mist, but also prevents electronic components from short-circuiting due to the mist.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will be described below with reference to the attached drawings. Although various limitations are given to the following embodiment as a specific preferred example of the invention, the scope of the invention is not to be limited to this embodiment unless otherwise specified in the following description. Furthermore, the following description is directed to an example where a liquid ejecting apparatus according to an embodiment of the invention is applied to an ink jet printing apparatus (referred to as "printer" hereinafter).

Figure 1:
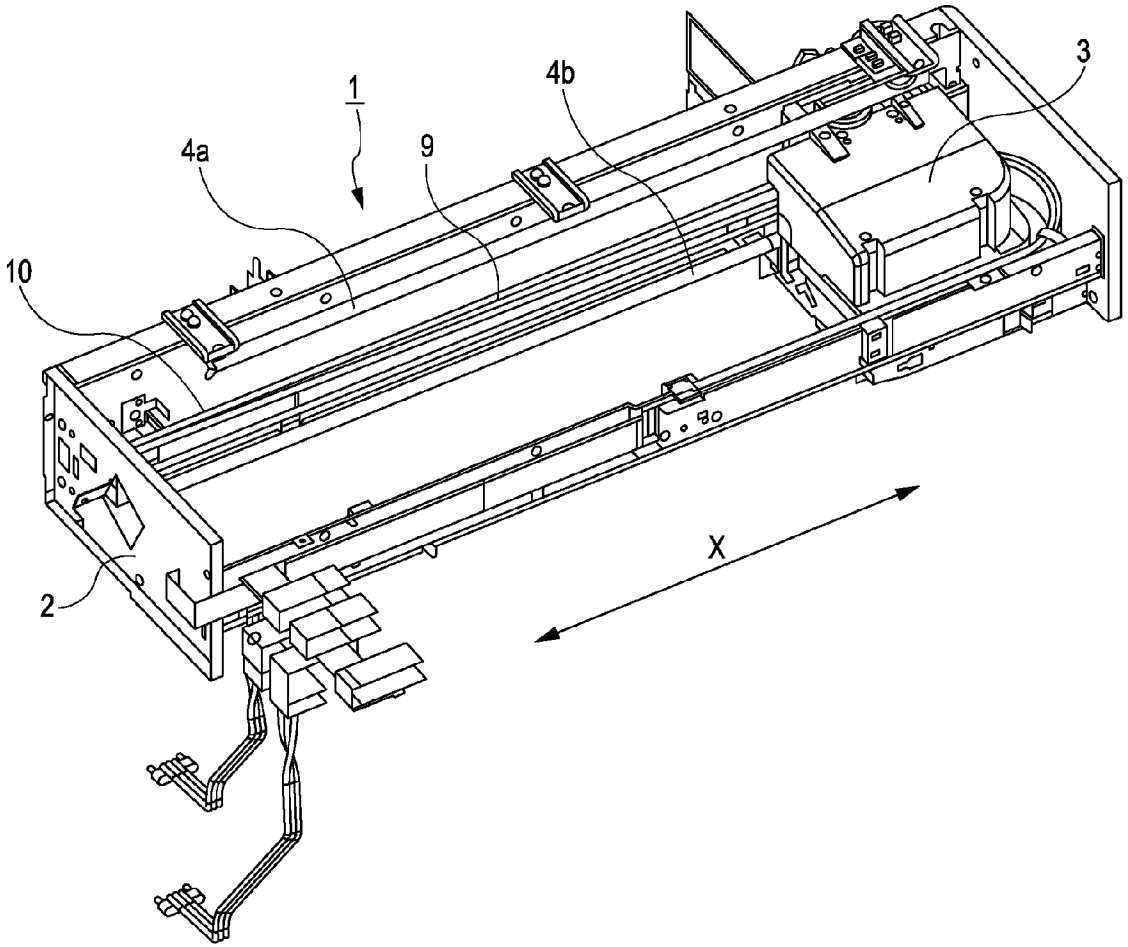
FIG. 1 is a perspective view showing a part of an internal configuration of a printer.
Figure 2:
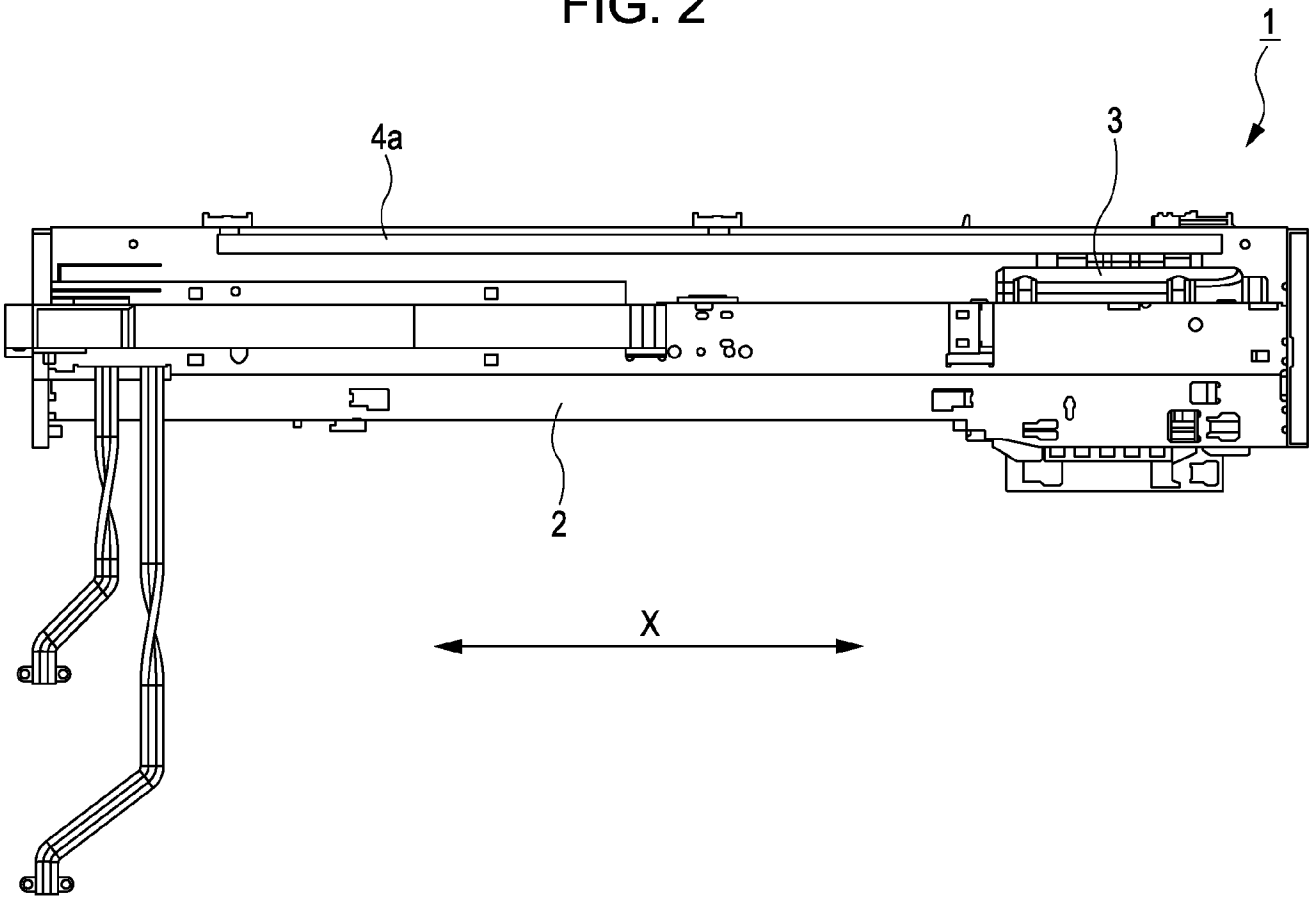
FIG. 2 is a front view of the printer.
Figure 3:
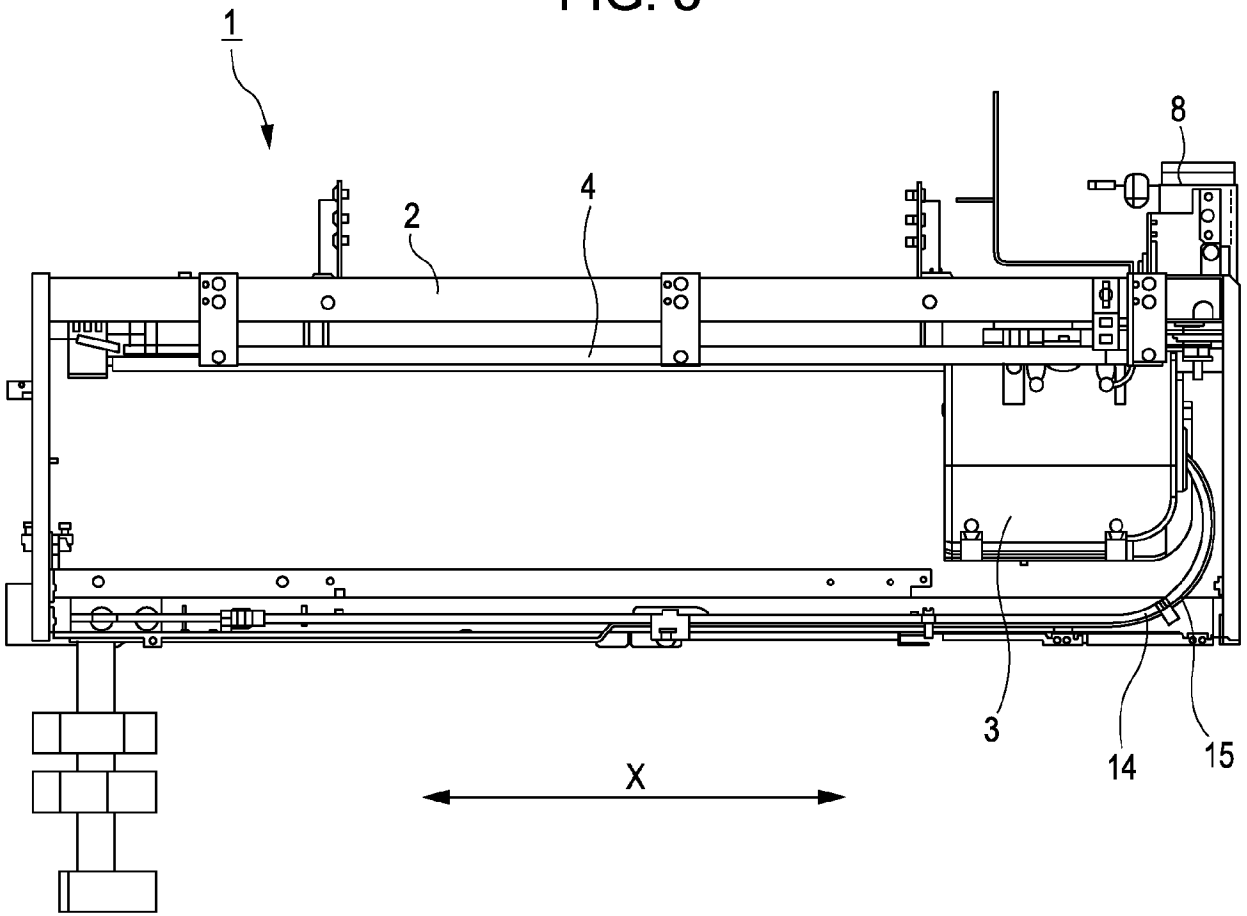
FIG. 3 is a plan view of the printer.
Figure 4:
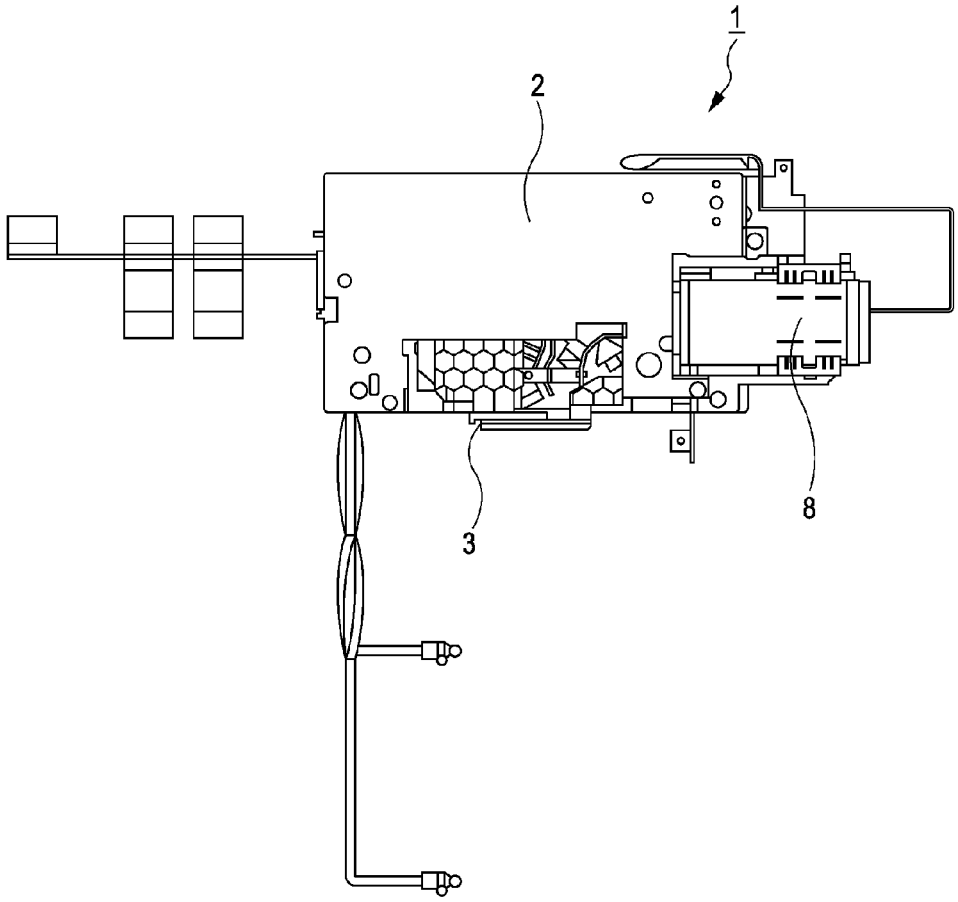
FIG. 4 is a right side view of the printer.

FIG. 1 is a perspective view showing a part of an internal configuration of a printer 1. FIG. 2 is a front view of the printer 1. FIG. 3 is a plan view of the printer 1. FIG. 4 is a right side view of the printer 1. The printer 1 shown in the drawings ejects ink, which is a kind of a liquid, toward a recording medium (corresponding to an ejection target object), such as a recording sheet, cloth, or a film (not shown). In the printer 1, a carriage assembly 3 is disposed in a frame 2 in a reciprocable manner in the main scanning direction (indicated by reference character X in FIG. 1) extending perpendicularly to the transport direction of the recording medium. An upper guide rod 4*a* and a lower guide rod 4*b* disposed parallel to each other with a certain distance therebetween and extending longitudinally in parallel to the longitudinal direction of the frame 2 are attached to an inner wall of the frame 2 at the rear side of the printer 1. The guide rods 4*a* and 4*b* are fitted to bearings 7 (see FIG. 7) provided at the rear face of the carriage assembly 3 so that the carriage assembly 3 is slidably supported by these guide rods 4*a* and 4*b*.

A carriage motor 8 serving as a driving source for moving the carriage assembly 3 is disposed at one end (i.e., right end in FIG. 3), in the main scanning direction X, of the rear face of the frame 2. A drive shaft of this carriage motor 8 protrudes inward from the rear face of the frame 2, and an end of the drive shaft is connected with a drive pulley (not shown). The drive pulley is rotated by being driven by the carriage motor 8. A free rotating pulley (not shown) is provided at a position (i.e., left end in FIG. 3) opposite to the drive pulley in the main scanning direction X. A timing belt 9 is bridged between these pulleys. The timing belt 9 is connected with the carriage assembly 3. When the carriage motor 8 is driven, the timing belt 9 rotates with the rotation of the drive pulley so that the carriage assembly 3 moves along the guide rods 4*a* and 4*b* in the main scanning direction X.

At the inner rear wall of the frame 2, a linear scale (encoder film) 10 extends parallel to the guide rods 4*a* and 4*b* in the main scanning direction X. The linear scale 10 is a band-like member made of a transparent resin film and is formed by, for example, printing multiple opaque stripes on a surface of a transparent base film such that the stripes extend crosswise to the width direction of the band. The stripes have the same width and are arranged at a fixed pitch in the longitudinal direction of the band. A linear encoder (not shown) for optically reading the stripes of the linear scale 10 is provided at the rear face of the carriage assembly 3. The linear encoder is constituted of, for example, a pair of a light emitter and a light receiver that are disposed facing each other, and is configured to output an encoder pulse in accordance with a difference between the light reception state in the transparent areas of the linear scale 10 and the light reception state in the stripe areas. Specifically, the linear encoder serves as a positional-information output unit that outputs an encoder pulse according to the scan position of the carriage assembly 3 as positional information in the main scanning direction X. Thus, a controller (not shown) of the printer 1 can control recording operation performed on the recording medium by a head unit 17 while detecting the scan position of the carriage assembly 3 on the basis of the encoder pulse from the linear encoder. Accordingly, the printer 1 is capable of performing so-called bidirectional recording for recording characters and images onto the recording medium in a bidirectional manner in an outbound mode and a homebound mode. Specifically, in the outbound mode, the carriage assembly 3 moves from a home position located at one end in the main scanning direction X (i.e., a standby position when the carriage assembly 3 is not driven) toward the opposite end (i.e. a full position), whereas, in the homebound mode, the carriage assembly 3 returns to the home position from the full position.

As shown in FIG. 3, the carriage assembly 3 is connected with ink supply tubes 14 for supplying color inks to recording heads 18 of the head unit 17, and also with signal cables 15 for supplying signals, such as drive signals. Although not shown, the printer 1 is also provided with a cartridge mounting section to which an ink cartridge (liquid supply source) containing the inks is detachably attached, a transport section that transports the recording medium, and a cap for covering a nozzle face 53 (to be described later) of each recording head 18 set on standby at the home position.

Figure 5:
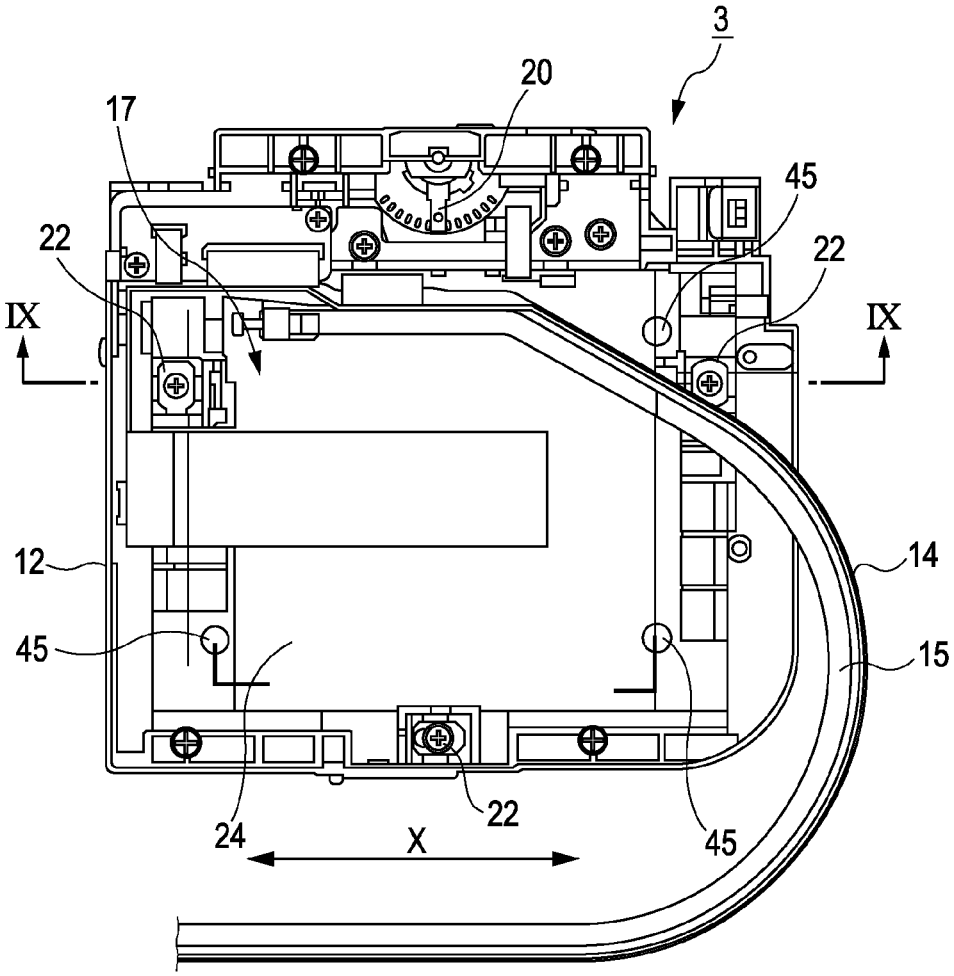
FIG. 5 is a plan view of a carriage assembly.
Figure 6:
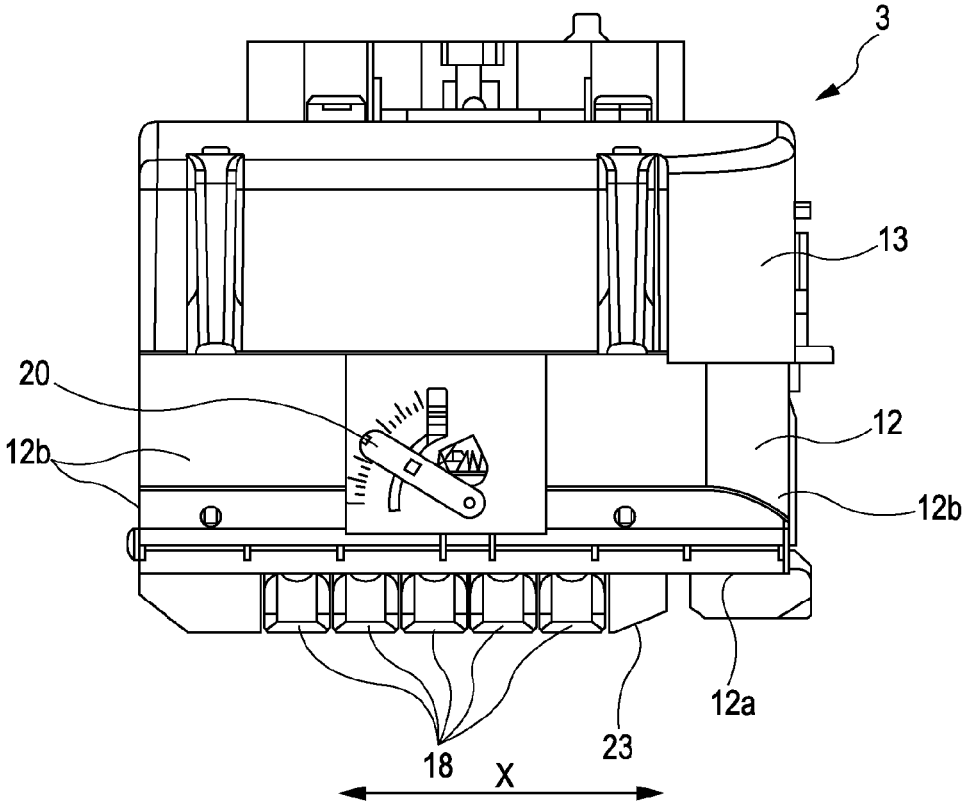
FIG. 6 is a front view of the carriage assembly.
Figure 7:
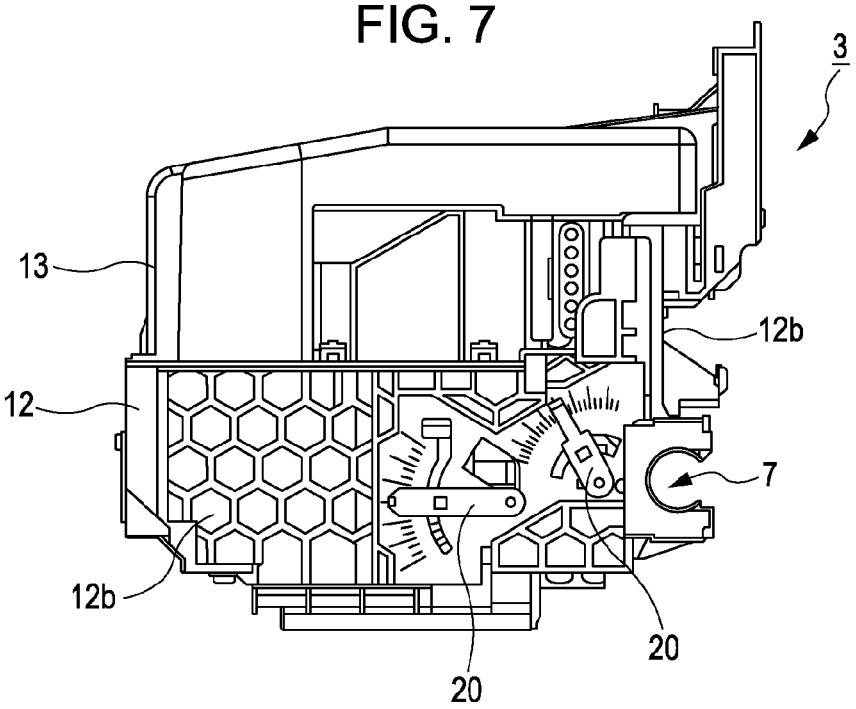
FIG. 7 is a right side view of the carriage assembly.
Figure 8:
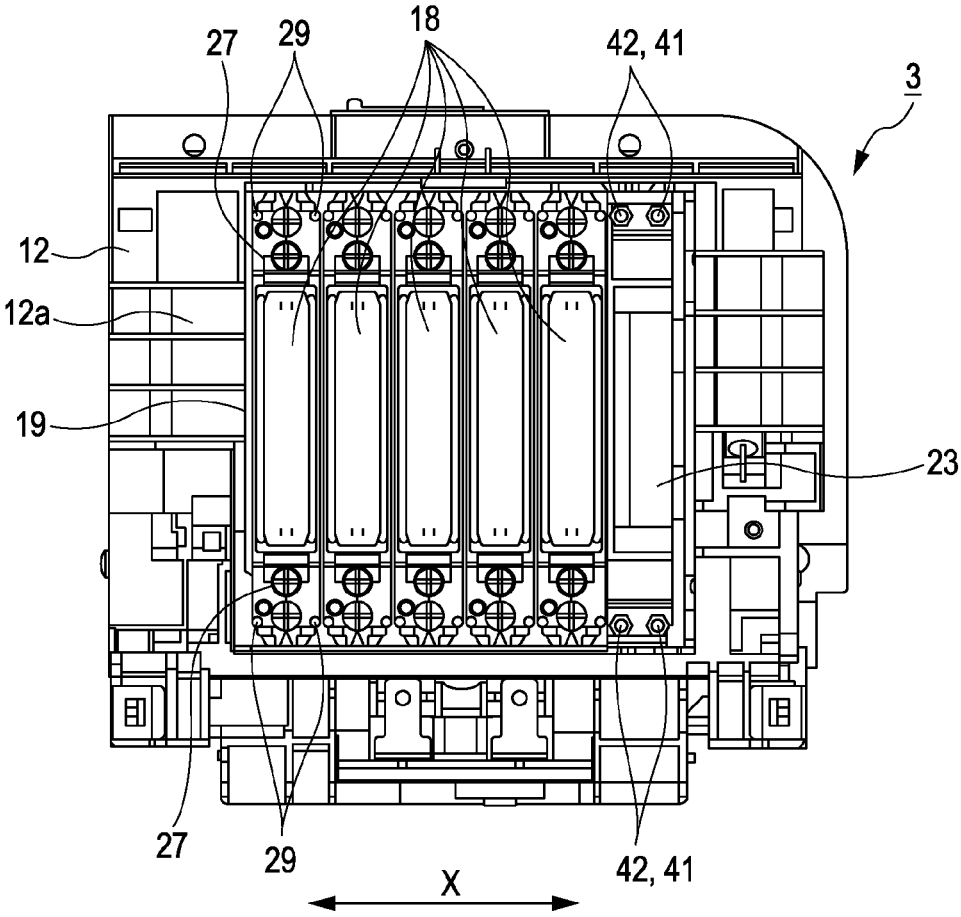
FIG. 8 is a bottom view of the carriage assembly.
Figure 9:
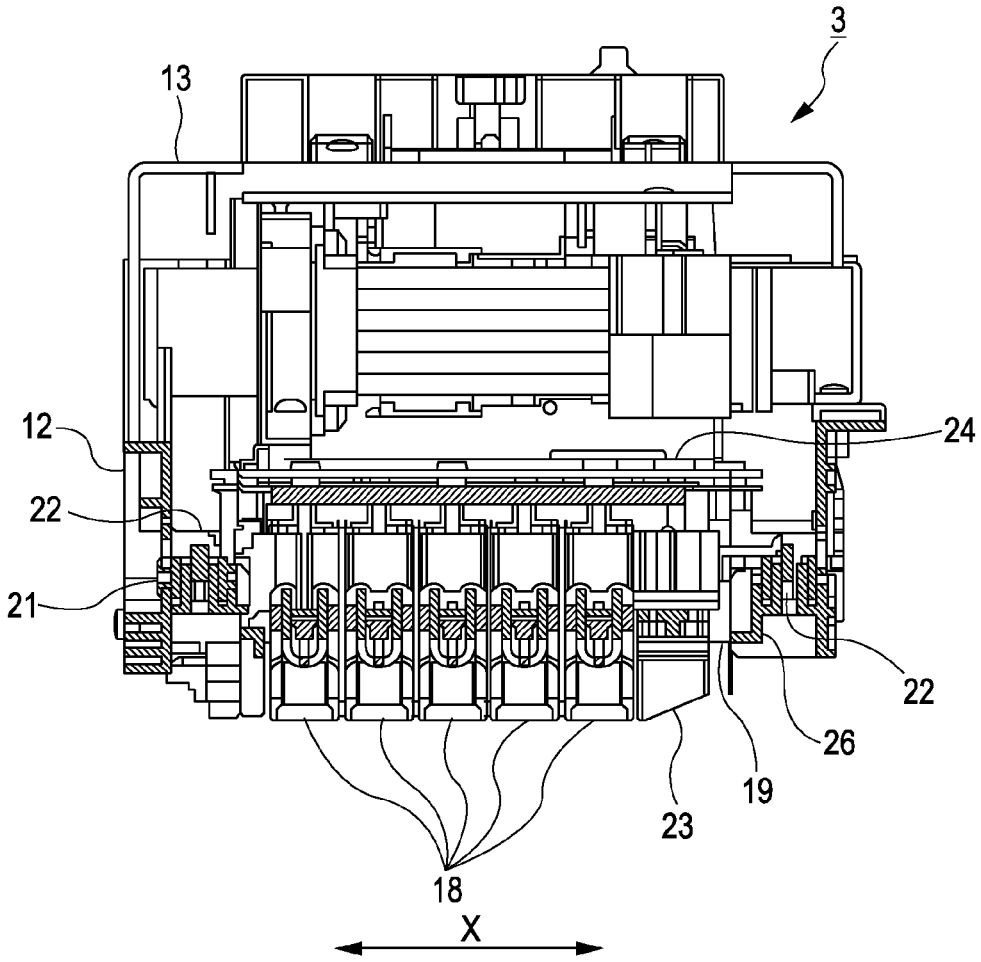
FIG. 9 is a cross-sectional view taken along line IX-IX in FIG. 5.

FIG. 5 is a plan (top) view of the carriage assembly 3. FIG. 6 is a front view of the carriage assembly 3. FIG. 7 is a right side view of the carriage assembly 3. FIG. 8 is a bottom view of the carriage assembly 3. FIG. 9 is a cross-sectional view taken along line IX-IX in FIG. 5. Specifically, FIG. 5 shows a state where a carriage cover 13 has been removed. The carriage assembly 3 is a hollow-box-like member that can be vertically split into two segments, which are a carriage body 12 that accommodates the head unit (corresponding to a liquid ejecting head unit), to be described later, and the carriage cover 13 that covers an upper opening of the carriage body 12. The carriage body 12 and the carriage cover 13 correspond to a casing member. The carriage body 12 is constituted of a substantially rectangular base plate 12*a* and sidewalls 12*b* standing upright from four outer edges of the base plate 12*a*, and accommodates the head unit 17 within a space surrounded by the base plate 12*a* and the sidewalls 12*b*. As shown in FIG. 8, the base plate 12*a* has a bottom opening 19 for exposing the nozzle faces 53 (see FIG. 16) of the recording heads 18 of the head unit 17. In the state where the head unit 17 is accommodated within the carriage body 12, the nozzle faces 53 of the recording heads 18 protrude lower than the base of the carriage body 12 through the bottom opening 19 (corresponding to an opening) of the base plate 12*a*.

Figure 15:
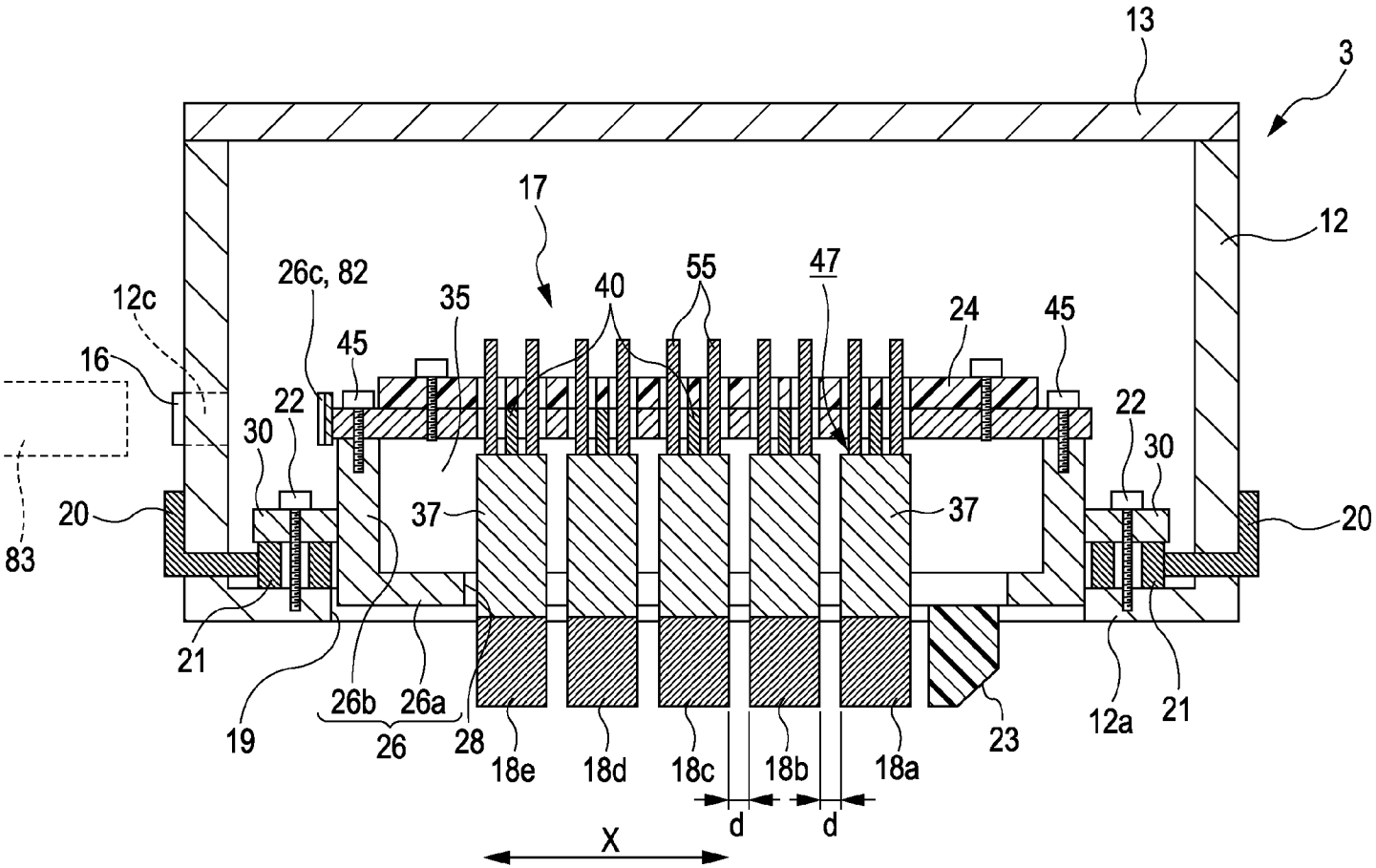
FIG. 15 is a cross-sectional view that shows the configuration of the carriage assembly in a simplified form.
Figure 20A:
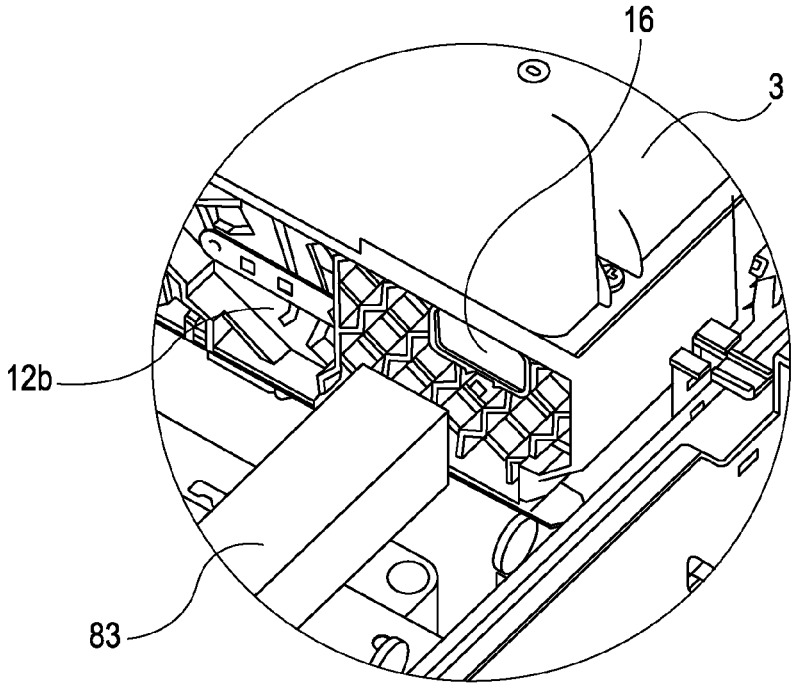
FIG. 20A is an enlarged view showing a cover member in an attached state in a region XX in FIG. 19.
Figure 20B:
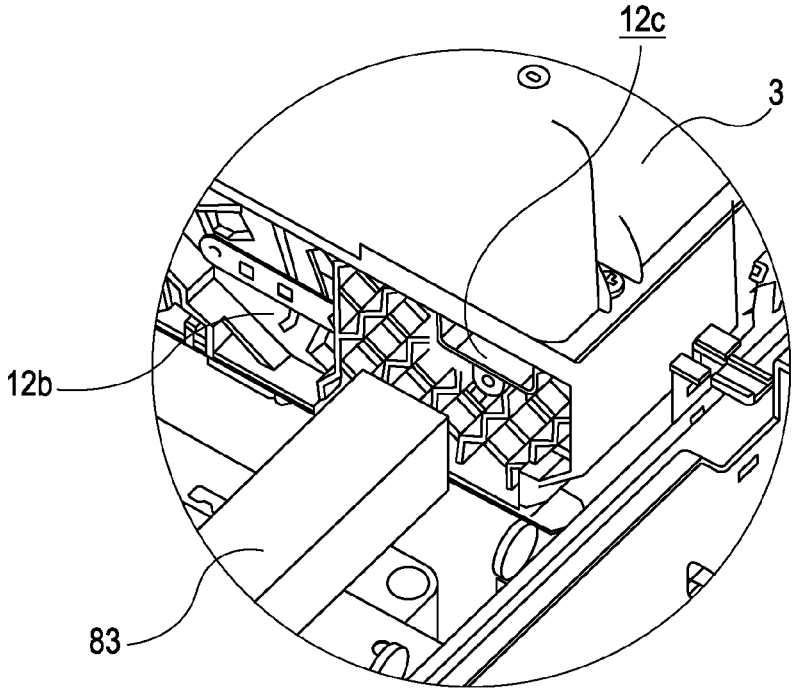
FIG. 20B is an enlarged view showing the cover member in a removed state.

Furthermore, as shown in FIGS. 15, 20A, and 20B, a substantially rectangular window 12*c* extending through one of the sidewalls 12*b* in the thickness direction thereof is provided in the sidewall 12*b* at a position facing a label bonding section 26*c*, to be described later. A cover member 16 that covers this window 12*c* is detachably provided at the front face of the window 12*c*. In this embodiment, in the state where the carriage assembly 3 is set on standby at the home position, the window 12*c* and the cover member 16 are provided in the sidewall 12*b* proximate to the full position. Furthermore, a screw hole for attaching the cover member 16 is formed in the aforementioned sidewall 12*b* at a position slightly lower than the window 12*c* (i.e., toward the base plate 12*a*). The cover member 16 is also provided with a through-hole that corresponds to this screw hole. In a state where the window 12*c* is covered by the cover member 16, a screw is inserted through the through-hole in the cover member 16 so as to be fastened to the screw hole, thereby fixing the cover member 16 to the sidewall 12*b*. The cover member 16 can be removed when a collective quick response (QR) label 82 (corresponding to a collective two-dimensional code) bonded to the label bonding section 26*c* is to be read, so that the collective QR label 82 can be read externally through the window 12*c*. This will be described in detail later. On the other hand, the cover member 16 is attached to the window 12*c* when the collective QR label 82 is not being read, thereby protecting the head unit 17. For example, mist created during ink ejection can be prevented from entering the carriage assembly 3. This not only prevents a state where the collective QR label 82 becomes dirty and unreadable due to the mist, but also prevents electronic components from short-circuiting due to the mist.

Furthermore, multiple eccentric cams 21 (see FIGS. 9 and 15) for adjusting the orientation of the head unit 17 accommodated within the carriage body 12 are provided between the carriage body 12 and the head unit 17. The carriage body 12 is provided with a plurality of adjusting levers 20 for rotating the eccentric cams 21. By operating each of these adjusting levers 20, the corresponding eccentric cam 21 rotates, causing the cam diameter from the center of rotation to the outer peripheral surface to increase and decrease. With the increase and decrease of the cam diameter, the orientation, such as the position and the inclination, of the head unit 17 accommodated in the carriage body 12 relative to the carriage body 12 can be adjusted.

Figure 10A:
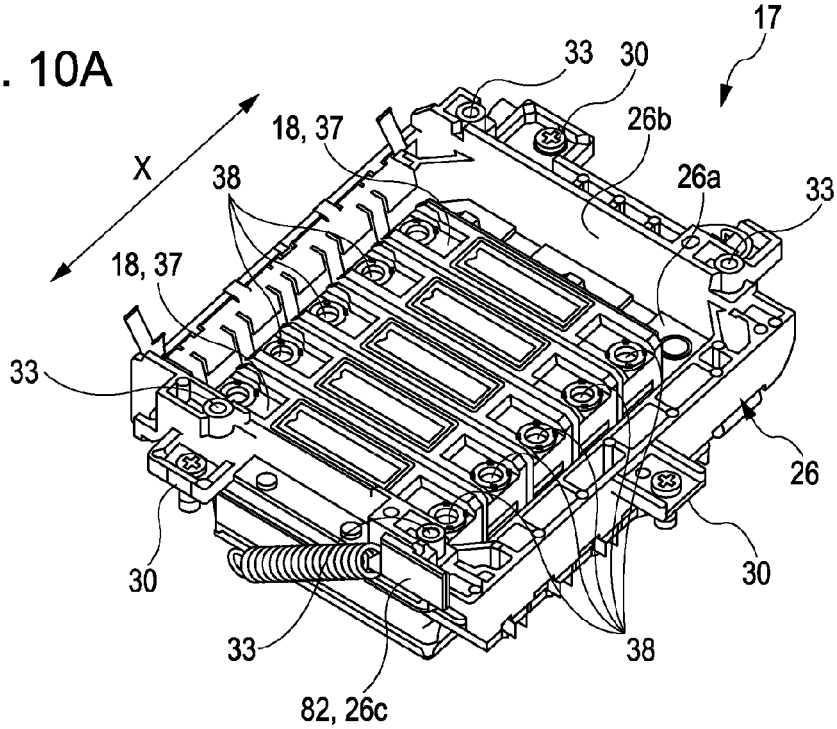
FIGS. 10A and 10B are a front perspective view and a rear perspective view, respectively, of a head unit from which a channel member has been removed.
Figure 10B:
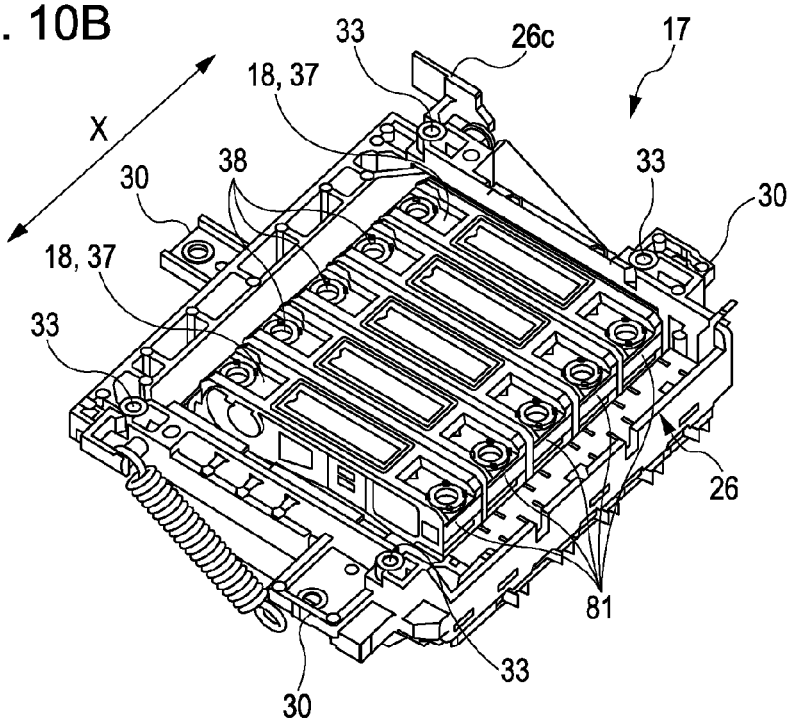
Figure 11:
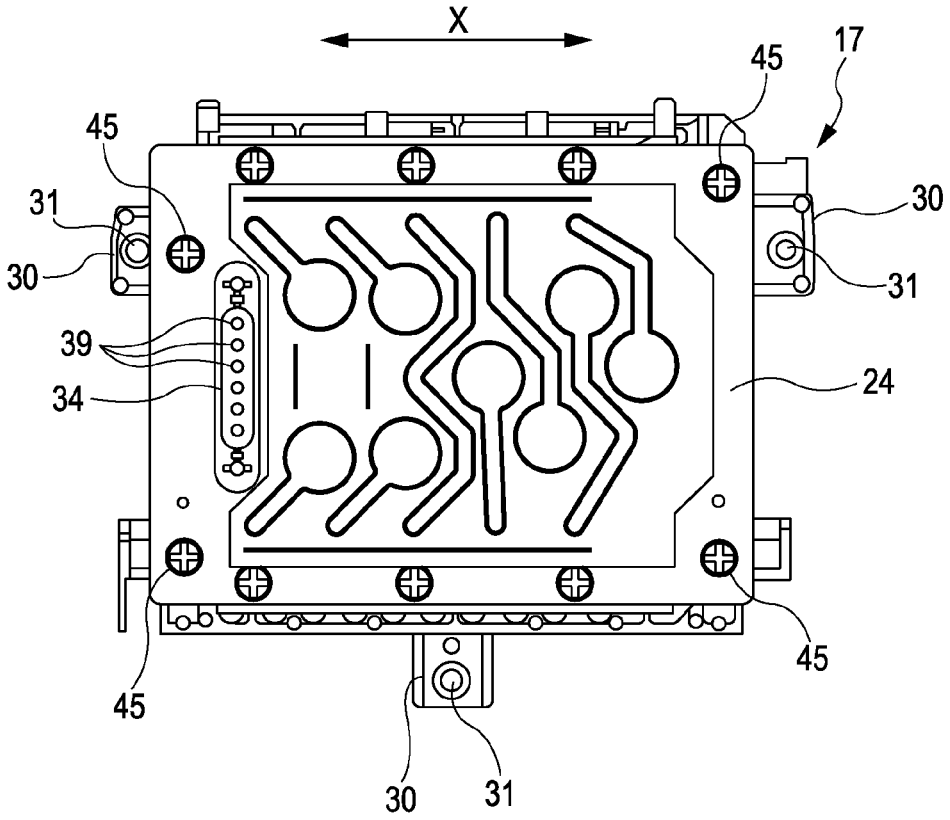
FIG. 11 is a plan view of the head unit.
Figure 12:
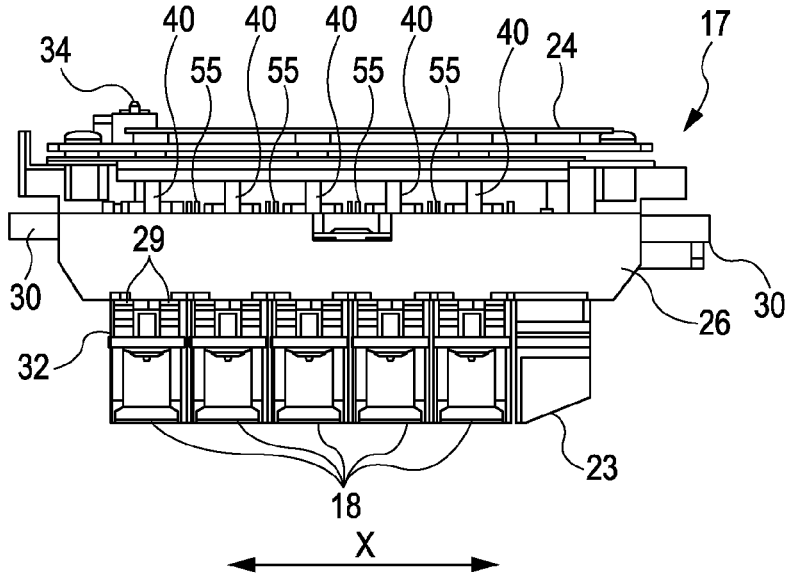
FIG. 12 is a front view of the head unit.
Figure 13:
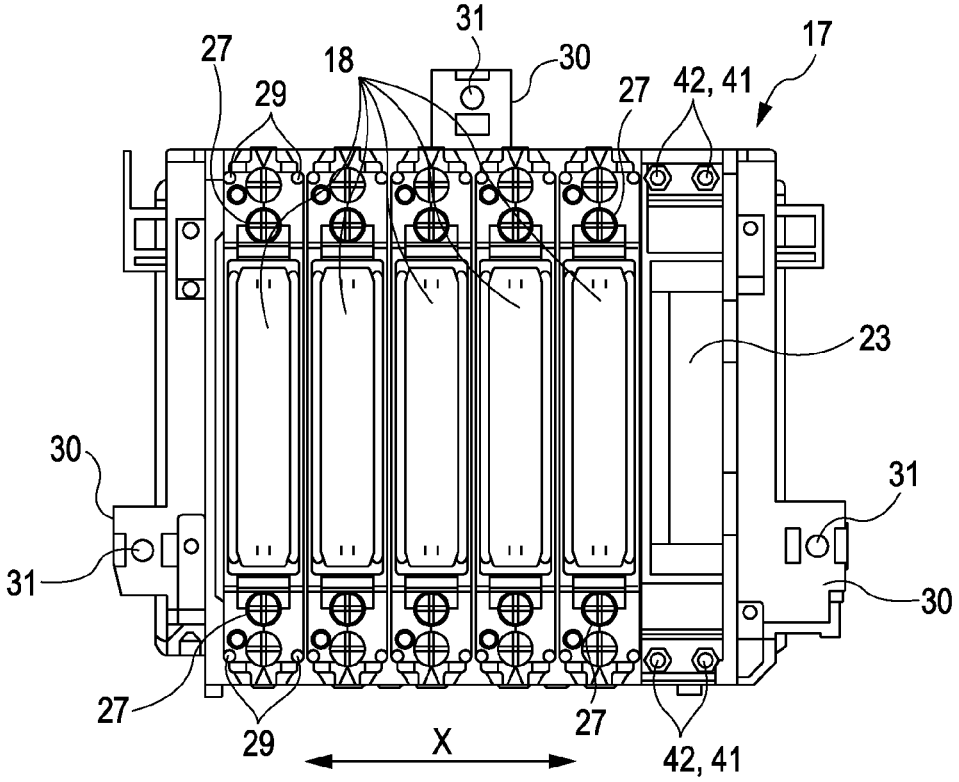
FIG. 13 is a bottom view of the head unit.
Figure 14:
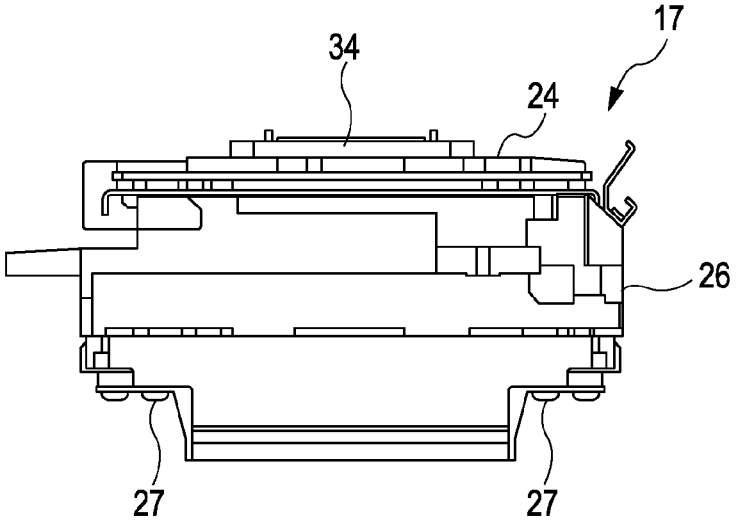
FIG. 14 is a right side view of the head unit.

FIGS. 10A and 10B are a front perspective view and a rear perspective view, respectively, of the head unit 17 from which a channel member 24 has been removed. FIG. 11 is a plan view (top view) of the head unit 17. FIG. 12 is a front view of the head unit 17. FIG. 13 is a bottom view of the head unit 17. FIG. 14 is a right side view of the head unit 17. FIG. 15 is a cross-sectional view that shows the configuration of the carriage assembly 3 in a simplified form for facilitating the description. Because FIG. 15 schematically shows the configuration, the shapes of the components and the positional relationship therebetween may differ from actuality.

The head unit 17 includes a combination of the multiple recording heads 18, a sub carriage 26, and the channel member 24. The recording heads 18 are attached in a parallel arrangement to the sub carriage 26. The sub carriage 26 has a hollow-box-like shape with an upper opening, and includes a tabular base 26*a* to which the recording heads 18 are fixed, upright walls 26*b* standing upright from four outer edges of the base 26*a*, and the label bonding section 26*c* protruding from a part of one of the upright walls 26*b* toward one side in the main scanning direction X. A space surrounded by the base 26*a* and the four upright walls 26*b* functions as an accommodating section 35 (see FIG. 15) that accommodates at least a portion (mainly sub tanks 37) of the recording heads 18. The sub carriage 26 in this embodiment is composed of metal, such as aluminum, so as to be given high rigidity. A single head insertion opening 28 (shared by the recording heads 18) into which the multiple recording heads 18 can be inserted is formed substantially in a central region of the base 26*a*. Therefore, the base 26*a* is a frame member with the shape of a picture frame. The lower surface of the base 26*a* (i.e., a surface thereof that faces the recording medium during recording) is provided with fixation holes (internal threads) 29 in correspondence with the attachment positions of the recording heads 18 (see FIG. 12). In this embodiment, for each recording head 18, there are a total of four fixation holes 29 provided in correspondence with the attachment positions of the recording head 18. Specifically, for each recording head 18, two pairs of fixation holes 29, which are provided in correspondence with attachment holes of spacers 32, flank the head insertion opening 28 in the nozzle-array direction.

In the state where the carriage assembly 3 is set on standby at the home position, the label bonding section 26*c* is provided in the shape of a plate that protrudes toward the full position (i.e., leftward in FIG. 15) from the upright wall 26*b* proximate to the full position and whose end is parallel to the side surface of the upright wall 26*b*. The collective QR label 82 is bonded to an outer surface of this plate portion. The collective QR label 82 is a sticker-like member having a so-called QR code (registered trademark), from which information can be optically read, printed on the front surface thereof. The back surface of the collective QR label 82 has an adhesive applied thereon. The collective QR label 82 includes arrangement information of the recording heads 18 in the head unit 17 (i.e., positional information thereof in the sub carriage 26) and collective information including a group of information recorded in individual QR labels 81 (to be described later). In addition to the arrangement information and the collective information, information related to the alignment of the recording heads 18 in the head unit 17 can also be recorded in the collective QR label 82. For example, information about at least one of the relative position and the inclination of nozzles 51 or the nozzle faces 53 of the recording heads 18 in the head unit 17 may be recorded in the collective QR label 82. The information recorded in the collective QR label 82 will be described in detail later.

Furthermore, as shown in FIGS. 10A and 10B, lug-like flanges 30 protrude laterally from three of the four upright walls 26*b* of the sub carriage 26. The flanges 30 are provided with through-holes 31 in correspondence with three attachment screw holes (not shown) formed in the base plate 12*a* of the carriage body 12 relative to the attachment positions of the head unit 17. In a state where the through-holes 31 are positionally aligned with the corresponding attachment screw holes in the base plate 12*a* of the carriage body 12, head-unit fixing screws 22 are inserted through the through-holes 31 so as to be fastened to the attachment screw holes, whereby the head unit 17 is accommodated and fixed within the carriage body 12. As mentioned above, prior to tightly fixing the head unit 17 to the carriage body 12, the aforementioned adjusting levers 20 are operated so as to adjust the orientation, such as the position and the inclination, of the head unit 17 relative to the carriage body 12. A total of four fixation screw holes 33 for fixing the channel member 24 in position are provided at the upper edges of the four upright walls 26*b* of the sub carriage 26.

As shown in FIG. 12, the channel member 24 is a box-like member that is thin in the vertical direction, and is composed of, for example, synthetic resin. The channel member 24 is provided with ink distribution channels (not shown) for the respective colors in correspondence with channel connection sections 38 of the sub tanks 37 (to be described later) of the recording heads 18. The upper surface of the channel member 24 is provided with a tube connection section 34. As shown in FIG. 11, multiple inlets 39 that correspond to the respective color inks are provided inside the tube connection section 34. Each inlet 39 communicates with the ink distribution channel for the corresponding color ink. When the aforementioned ink supply tubes 14 are connected to the tube connection section 34, the ink supply channels for the respective colors within the ink supply tubes 14 and the corresponding inlets 39 are connected in communication with each other in a liquid-tight state. Thus, the color inks delivered from the ink cartridge side via the ink supply tubes 14 are introduced to the ink distribution channels within the channel member 24 via the inlets 39. The four corners of the channel member 24 are provided with channel through-holes (not shown) that correspond to the fixation screw holes 33 in the sub carriage 26 and that extend through the channel member 24 in the thickness direction thereof. When the channel member 24 is to be fixed to the sub carriage 26, channel-member fastening screws 45 are inserted through the channel through-holes so as to be fastened (screwed) to the fixation screw holes 33.

Furthermore, as shown in FIGS. 12 and 15, connection channels 40 extend downward from the lower surface of the channel member 24. Specifically, the connection channels 40 are provided at positions corresponding to the channel connection sections 38 of the sub tanks 37 of the recording heads 18, and are hollow tubular members each having therein a delivery channel (not shown) that communicates with the ink distribution channel for the corresponding color ink. The connection channels 40 are inserted and coupled in a liquid-tight manner to the channel connection sections 38 of the sub tanks 37 of the recording heads 18. The inks traveling through the ink distribution channels within the channel member 24 are supplied to the sub tanks 37 of the recording heads 18 via the connection channels 40 and the channel connection sections 38. Specifically, the ink supply tubes 14 and the sub tanks 37 of the recording heads 18 are connected to each other via the channel member 24.

In this embodiment, a total of five recording heads (18*a* to 18*e*) are attached to the head unit 17 with the spacers 32 (see FIG. 12) interposed therebetween. The spacers 32 are composed of synthetic resin. For each recording head 18, a total of two spacers 32 are attached respectively to the upper surfaces (i.e., surfaces proximate to the sub tank 37) of flanges 52*a* (see FIG. 16) provided at opposite sides of the recording head 18. In a central region of each spacer 32 in the width direction (i.e., a direction perpendicular to a nozzle array 56 when the spacer 32 is attached to the recording head 18), a head through-hole (not shown) is provided in correspondence with a spacer attachment hole 54 of the recording head 18. Thus, before each recording head 18 is attached to the sub carriage 26, the spacers 32 are fastened to the flanges 52*a* at the opposite sides of the recording head 18 by using spacer fixing screws 27. Moreover, opposite ends of each spacer 32 in the width direction are provided with attachment holes (not shown) in correspondence with the fixation holes 29 provided in the sub carriage 26. By fastening screws to the fixation holes 29 via the attachment holes in the spacers 32, each recording head 18 is accommodated within the accommodating section 35 by inserting the sub tank 37 therein from below through the head insertion opening 28, and is fixed in position with the spacers 32 interposed between the recording head 18 and the base 26*a*. Specifically, the lower surface of the base 26*a* (i.e., the surface to which the spacers 32 are to be fixed) serves as a reference attachment position (i.e., a head-unit reference surface) of each recording head 18 relative to the head unit 17. In this case, as shown in FIG. 13, the recording heads 18 are detachably fixed to the base 26*a* in a side-by-side arrangement in the direction perpendicular to the nozzle arrays 56 (i.e., the same direction as the main scanning direction X), to be described later, with a certain gap (denoted by reference character d in FIG. 15) therebetween. A head protection member 23 is disposed adjacent to the outer side, in the main scanning direction X, of the recording head 18 located at one end in the main scanning direction X (i.e., right end in FIG. 15) so as to protect a side surface of the recording head 18. The head protection member 23 is provided for protecting the recording heads 18 (in particular, the side surface of a recording head 18*a* located at the one end in the main scanning direction X) from the recording medium during the recording operation.

Figure 16:
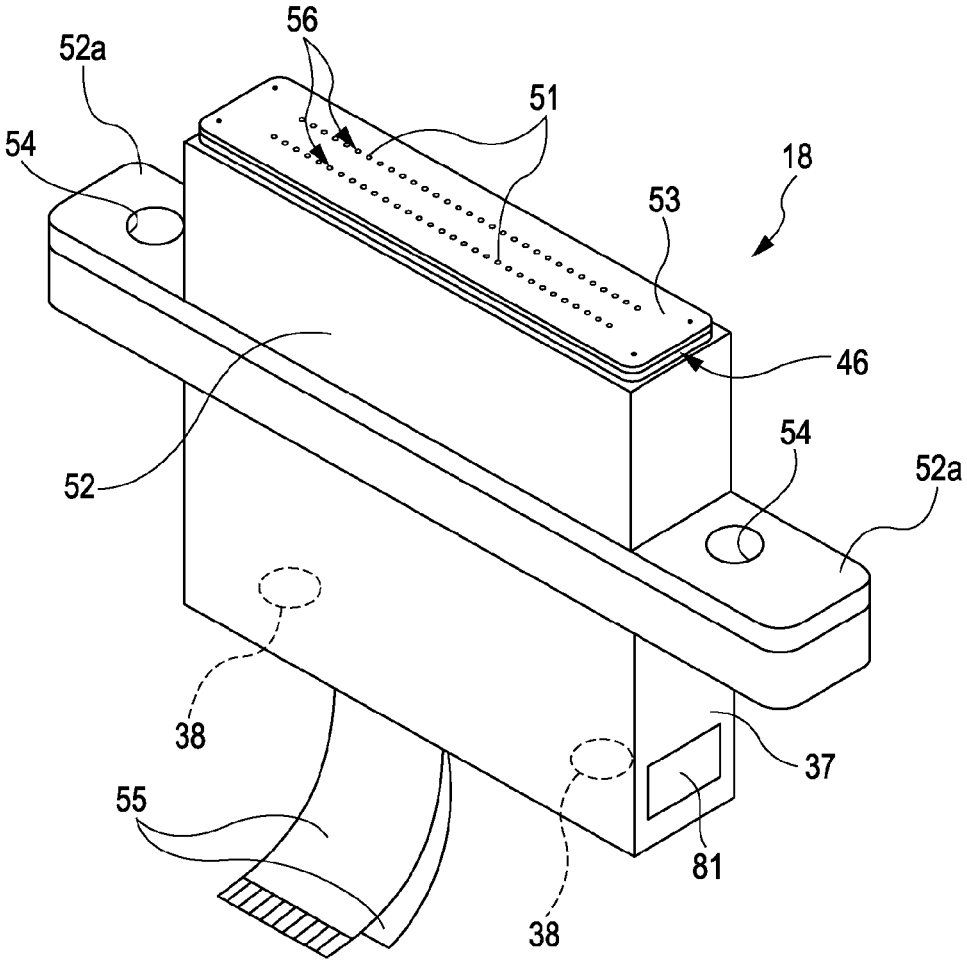
FIG. 16 is a perspective view for explaining the configuration of a recording head.
Figure 17:
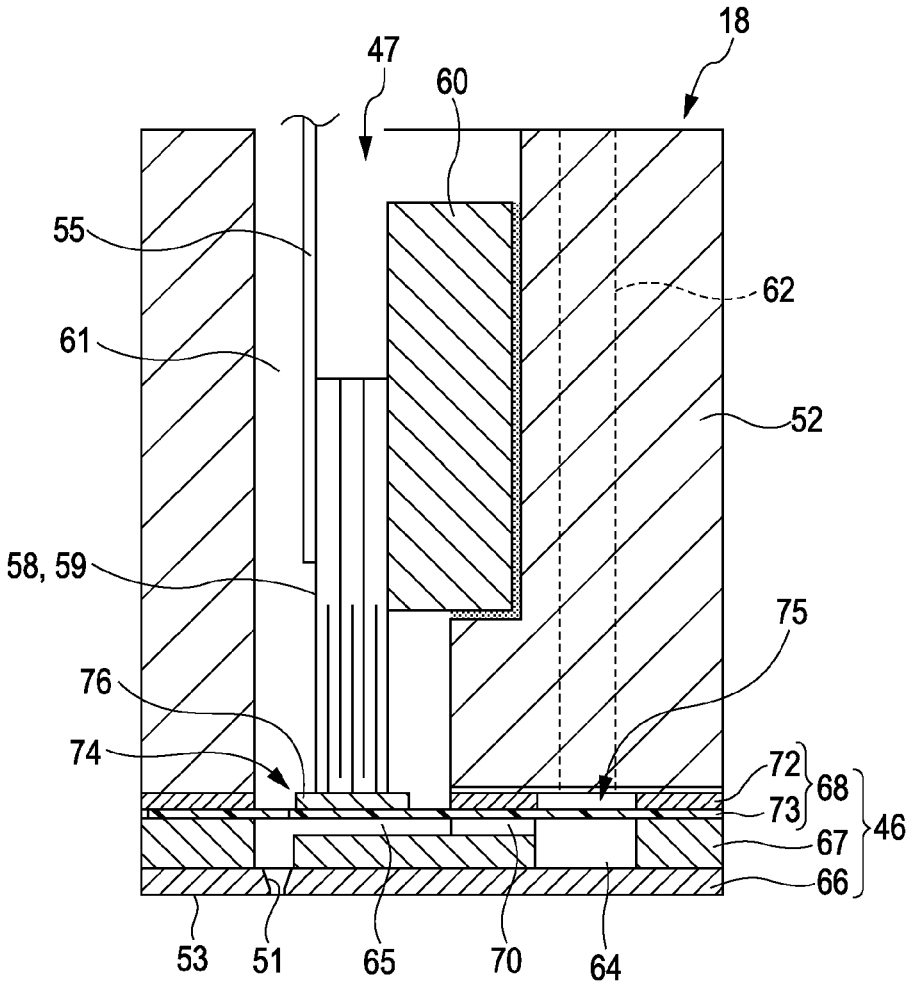
FIG. 17 is a cross-sectional view showing a relevant part of the recording head.

FIG. 16 is a perspective view for explaining the configuration of each of the recording heads 18 (corresponding to liquid ejecting heads). FIG. 17 is a cross-sectional view showing a relevant part of each recording head 18. Each recording head 18 is constituted of a head casing 52 equipped with a channel unit 46 that forms an ink channel communicating with the nozzles 51 and a vibrator unit 47 having pressure generators that generate pressure fluctuation within the channel, and the sub tank 37 attached to a base-end face (i.e., the upper surface) of the head casing 52 that is opposite to the nozzle face 53. Since the basic structure is the same among the recording heads 18, one of the five recording heads 18 attached to the sub carriage 26 is illustrated as a representative example.

First, the vibrator unit 47 will be described. The vibrator unit 47 is constituted of a piezoelectric vibrator group 58 including a plurality of piezoelectric vibrators 59 (corresponding to pressure generators), and flexible cables (wire members) 55. The piezoelectric vibrators 59 constituting the piezoelectric vibrator group 58 are formed into a comb-like structure that is slender in the longitudinal direction, and are cut into an extremely small width of about several tens of micrometers. The piezoelectric vibrators 59 are of a longitudinal vibration type that is expandable and contractible in the longitudinal direction. Each piezoelectric vibrator 59 has a stationary end that is joined to a stationary plate 60 and a free end that protrudes outward from an end of the stationary plate 60 so that the piezoelectric vibrator 59 is fixed in a so-called cantilevered state. As will be described later, the free end of each piezoelectric vibrator 59 is joined to an island region 76 constituting a diaphragm section 74 in the channel unit 46. The flexible cables 55 are electrically connected to the piezoelectric vibrators 59 at a side surface of the stationary end thereof opposite to the stationary plate 60. The stationary plate 60 supporting the piezoelectric vibrators 59 is formed of a metallic plate having enough rigidity for receiving reactive force from the piezoelectric vibrators 59. In this embodiment, the stationary plate 60 is formed using a stainless steel plate having a thickness of about 1 mm.

Next, the channel unit 46 will be described. The channel unit 46 is a thin plate member attached to the lower side (ejection target object side) of the head casing 52. The channel unit 46 is constituted of a combination of a nozzle plate 66, a channel formation substrate 67, and a diaphragm 68, and is formed by bonding the nozzle plate 66 to one surface of the channel formation substrate 67 and the diaphragm 68 to the other surface of the channel formation substrate 67 opposite to the nozzle plate 66 by using an adhesive.

The nozzle plate 66 disposed at the lower surface of the recording head 18 is a thin metallic plate provided with a plurality of nozzles 51 arranged at a pitch (e.g. 180 dpi) corresponding to a dot formation density in the direction perpendicular to the main scanning direction X. Therefore, the lower surface of the nozzle plate 66 serves as the nozzle face 53. Each of the nozzles 51 has a straight portion with a fixed inner diameter and whose axis is perpendicular to the nozzle face 53, and a tapered portion whose inner diameter decreases with increasing distance from the channel formation substrate 67 (i.e., toward the ink ejection side). A first end of the tapered portion opens in the surface of the nozzle plate 66 adjacent to the channel formation substrate 67, whereas a second end of the tapered portion is located at an intermediate position of the nozzle plate 66 in the thickness direction thereof. A first end of the straight portion communicates with the second end of the tapered portion, whereas a second end of the straight portion opens in the nozzle face 53. Furthermore, in this embodiment, for example, 180 nozzles 51 are arranged in arrays, and these nozzles 51 constitute two nozzle arrays 56.

The channel formation substrate 67 is a plate member that forms a series of ink channels constituted of a reservoir 64, an ink supply port 70, and pressure chambers 65. Specifically, the channel formation substrate 67 forms a plurality of spaces that are to become the pressure chambers 65 in correspondence with the nozzles 51 by using partitions, and also forms spaces that are to become the ink supply port 70 and the reservoir 64. In this embodiment, the channel formation substrate 67 is formed by performing etching on a silicon wafer. The aforementioned pressure chambers 65 are formed as chambers that are slender in the direction perpendicular to the nozzle array direction, and the ink supply port 70 is formed as a narrow portion that has a narrow channel width and that allows the pressure chambers 65 and the reservoir 64 to communicate with each other. The reservoir 64 is provided for supplying ink stored in the ink cartridge to the pressure chambers 65 and communicates with the corresponding pressure chambers 65 via the ink supply port 70.

The diaphragm 68 is a double-layer composite plate formed by laminating a resin film 73 composed of, for example, polyphenylene sulfide (PPS) over a support plate 72 composed of metal, such as stainless steel. The diaphragm 68 has the diaphragm section 74 for changing the capacity of each pressure chamber 65 by sealing one open surface of the pressure chamber 65, and a compliance section 75 that seals one open surface of the reservoir 64. In the diaphragm section 74, the island region 76 for joining together the free ends of the piezoelectric vibrators 59 is formed by performing etching on a region of the support plate 72 that corresponds to the pressure chamber 65 so as to annularly remove the region. Similar to the planar shape of the pressure chamber 65, the island region 76 has a block shape that is slender in the direction perpendicular to the array direction of the nozzles 51, and the resin film 73 surrounding the island region 76 functions as an elastic film. With regard to a region that is to function as the compliance section 75, that is, a region that corresponds to the reservoir 64, a corresponding region of the support plate 72 is removed by etching in conformity to the opening shape of the reservoir 64, so that only the resin film 73 remains.

Next, the head casing 52 will be described. The head casing 52 is a hollow-box-like member, and the channel unit 46 is fixed to an end thereof with the nozzle face 53 in an exposed state. The base-end face (i.e., the upper surface) of the head casing 52 opposite to the nozzle face 53 has the sub tank 37 attached thereto for supplying ink toward the channel unit 46. Furthermore, the flanges 52*a* protrude laterally from the opposite sides, in the nozzle array direction, of the upper surface of the head casing 52. The flanges 52*a* are provided with the spacer attachment holes 54 in correspondence with the head through-holes of the aforementioned spacers 32. When the spacers 32 are to be attached to the flanges 52*a*, the spacer fixing screws 27 are inserted through these spacer attachment holes 54. In the head casing 52, an accommodation space 61 for accommodating the vibrator unit 47 and a casing channel 62 for supplying the ink from the sub tank 37 to the reservoir 64 extend through the head casing 52 in the height direction thereof. The casing channel 62 has one end communicating with the reservoir 64 and another end communicating with the interior of the sub tank 37 in a liquid-tight manner.

The sub tank 37 is configured to introduce the ink from the channel member 24 to each pressure chamber 65 via the casing channel 62 and the reservoir 64. The sub tank 37 has a self sealing function for controlling the introduction of ink toward each pressure chamber 65 by opening and closing a valve in accordance with internal pressure fluctuation. The channel connection sections 38 connected with the connection channels 40 of the channel member 24 are provided at opposite ends, in the nozzle array direction, of the rear end surface (upper surface) of the sub tank 37. Ring-shaped gaskets (not shown) are fitted to the channel connection sections 38 so that the channel connection sections 38 and the connection channels 40 are maintained in a liquid-tight manner by the gaskets. In the sub tank 37, a space through which the flexible cables 55 extending from the head casing 52 can be inserted is formed so as to extend through the sub tank 37 in the height direction thereof. In this embodiment, two flexible cables 55 extend through the interior of the sub tank 37 so as to be routed toward the rear end surface of the sub tank 37 (see FIG. 16). The flexible cables 55 are connected to the aforementioned signal cables 15 and supply a drive signal transmitted from the controller of the printer 1 via the signal cables 15 to the piezoelectric vibrator group 58 via a drive substrate.

As shown in FIGS. 10B and 16, each individual QR label 81 (corresponding to an individual two-dimensional code) is bonded to one of outer walls of the corresponding sub tank 37 that is perpendicular to the nozzle array direction (i.e., the rear surface when the printer 1 is viewed from the front in this embodiment). Like the collective QR label 82, each individual QR label 81 is a sticker-like member whose front surface has a QR code printed thereon and whose back surface has an adhesive applied thereon. Each individual QR label 81 includes at least one piece of information related to the corresponding recording head 18. In this embodiment, information related to a drive voltage of the recording head 18 is recorded in the individual QR label 81. A detailed description will be provided later.

Accordingly, since the free ends of the piezoelectric vibrators 59 are joined to the island region 76, the free ends of the piezoelectric vibrators 59 are expanded or contracted in accordance with a drive signal transmitted from the controller, thereby changing the capacity of each pressure chamber 65. This change in the capacity causes pressure fluctuation to occur in the ink within the pressure chamber 65. By utilizing this pressure fluctuation, the recording head 18 ejects (emits) ink droplets from the nozzles 51.

Figure 18:
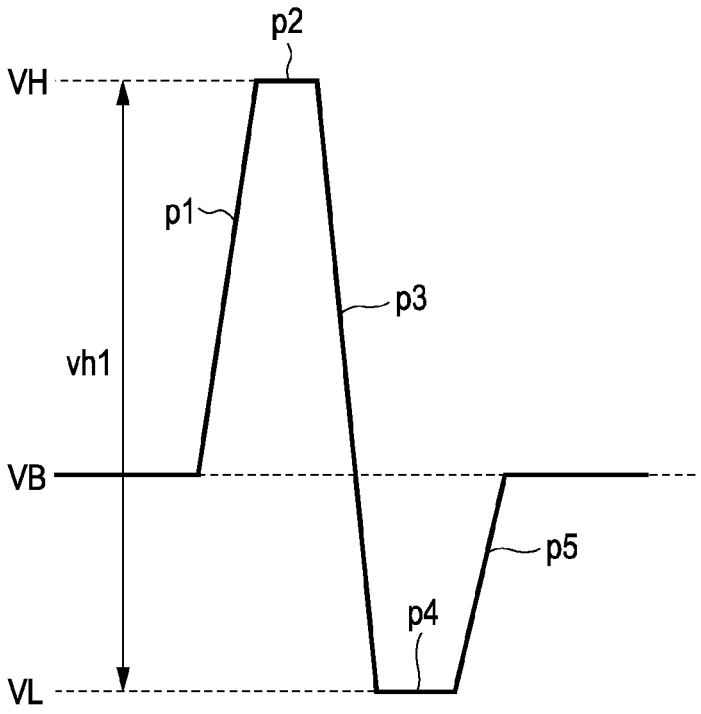
FIG. 18 is a waveform diagram for explaining a drive pulse included in a drive signal.

Next, the drive signal used for driving each of the aforementioned recording heads 18 will be described. FIG. 18 illustrates an example of one of drive pulses included in the drive signal. In FIG. 18, the ordinate denotes the electric potential of the drive pulse, whereas the abscissa denotes time. A potential difference (drive voltage) between a minimum electric potential VL and a maximum electric potential VH of the drive pulse is set as vhf. The drive pulse includes an expansion component p1 that changes in electric potential toward the positive side from a reference electric potential VB to the maximum electric potential VH so as to expand a pressure chamber 65, an expansion maintaining component p2 that maintains the maximum electric potential VH for a certain period of time, a contraction component p3 that changes in electric potential toward the negative side from the maximum electric potential VH to the minimum electric potential VL so as to rapidly contract the pressure chamber 65, a contraction maintaining (vibration damping) component p4 that maintains the minimum electric potential VL for a certain period of time, and a recovery component p5 in which the electric potential recovers to the reference electric potential VB from the minimum electric potential VL.

The following operation is performed when the drive pulse is supplied to the piezoelectric vibrators 59. First, when the expansion component p1 is supplied to the piezoelectric vibrators 59, the piezoelectric vibrators 59 contract, causing the capacity of the corresponding pressure chamber 65 to change (in this case, expand) from a reference capacity corresponding to the reference electric potential VB to a maximum capacity corresponding to the maximum electric potential VH. Accordingly, a meniscus exposed in each nozzle 51 is drawn toward the corresponding pressure chamber 65. This expanded state of the pressure chamber 65 is maintained over a period in which the expansion maintaining component p2 is supplied.

After the expansion maintaining component p2, the contraction component p3 that changes the voltage in the direction opposite to the direction in which the voltage is changed by the expansion component p1 is supplied to the piezoelectric vibrators 59. This causes the piezoelectric vibrators 59 to expand so that the capacity of the pressure chamber 65 rapidly changes (in this case, contracts) from the maximum capacity to a minimum capacity corresponding to the minimum electric potential VL. This rapid contraction of the pressure chamber 65 causes the ink within the pressure chamber 65 to become compressed, thereby causing several pl to several tens of pl of ink to be ejected from the corresponding nozzle 51. This contracted state of the pressure chamber 65 is maintained for a short period of time in which the contraction maintaining component p4 is supplied. Subsequently, the recovery component p5 is supplied to the piezoelectric vibrators 59 so that the capacity of the pressure chamber 65 recovers to the reference capacity corresponding to the reference electric potential VB from the capacity corresponding to the minimum electric potential VL.

By selectively outputting such a drive pulse from within the drive signal to the piezoelectric vibrators 59 in the recording head 18, liquid is ejected to the ejection target object from the corresponding nozzles 51. Moreover, by controlling this drive signal, the liquid ejecting operation of the recording head 18 can be controlled.

Next, a manufacturing process of the aforementioned printer 1 will be described. The manufacturing process of the printer 1 mainly includes a recording-head manufacturing process, a head-unit manufacturing process, a carriage-assembly manufacturing process, and a printer-body manufacturing process. The recording-head manufacturing process involves manufacturing the recording heads 18 by combining together the components. First, each recording head 18 is formed by combining together the channel unit 46, the vibrator unit 47, the head casing 52, and the sub tank 37. Subsequently, an ink to be used or an inspection liquid having properties equivalent thereto is introduced into the recording head 18, and a separately prepared inspection drive signal is input so as to measure the liquid ejection properties. For example, drive signals with different minimum electric potentials VL or different maximum electric potentials VH are sequentially input so as to eject the liquid, and the amount (i.e., weight or volume) of the liquid and the liquid ejecting speed (traveling speed) are measured. Based on the measurement result, an optimal drive voltage value of the drive pulse for achieving target ejection properties in terms of design and usage is determined. Then, an individual QR label 81 having recorded therein this optimal value together with a serial number is issued and bonded to the side surface of the sub tank 37. The remaining recording heads 18 that are to constitute the head unit 17 are manufactured in the same manner, and optimal drive voltage values according to inks to be used therein are recorded in the respective individual QR labels 81. Alternatively, the individual QR labels 81 may include other information related to the recording heads 18. For example, for each recording head 18, information, such as natural vibration period information (Tc rank) of pressure vibration occurring in the ink in each pressure chamber 65, liquid-amount identification information (color adjust ID) indicating a variation in the amount of liquid ejected from the nozzles 51 in each nozzle array 56, and frequency characteristic information (frequency characteristic ID) related to the amount or the traveling speed of the liquid ejected from the nozzles 51 by repeatedly applying a drive pulse to the piezoelectric vibrators 59, may be measured and recorded in the corresponding individual QR label 81.

Generally, the aforementioned natural vibration period information (Tc) can be expressed with the following expression (1).

$$Tc=2\pi\sqrt{[Mn+Ms)/(Mn\times Ms\times(Cc+Ci))]} \quad (1)$$

In expression (1), Mn denotes inertance (i.e., the mass of ink per unit cross-sectional area) in each nozzle 51, Ms denotes inertance in the ink supply port 70, Cc denotes compliance (i.e, a change in capacity per unit pressure, which indicates the degree of softness) of each pressure chamber 65, and Ci denotes compliance of the ink (Ci=volume V/[density ρ×sonic velocity $c^2$]). Tc rank refers to an indicator given to the recording head 18 in accordance with a value obtained by actually measuring the Tc of the recording head 18. The color adjust ID refers to information indicating a deviation or a ratio relative to a design reference value for the amount of ink in each nozzle array 56 (i.e., an average value of the amount of ink in all of the nozzles 51 belonging to the same nozzle array 56). Furthermore, the frequency characteristic ID is an indicator that indicates a change in the amount of ink occurring due to a change in the ejection frequency within a predetermined range when the ink is continuously ejected from the nozzles 51.

The head-unit manufacturing process involves manufacturing the head unit 17 by fixing the recording heads 18 to the sub carriage 26. Specifically, the recording heads 18 manufactured in the recording-head manufacturing process are positioned and fixed to predetermined positions of the sub carriage 26. Then, alignment information of the recording heads 18 fixed to the sub carriage 26 is measured. For example, a nozzle-to-nozzle distance of each recording head 18 (in particular, a nozzle-to-nozzle distance between recording heads 18 having nozzle arrays 56 that eject the same color ink), a relative height of the nozzle face 53 of each recording head 18 (or the position of the nozzle face 53 on the basis of the sub carriage 26), and the inclination of the nozzle face 53 (i.e., the inclination thereof relative to the base 26*a*) are measured. Furthermore, information is read from the individual QR label 81 of each recording head 18 by using a QR label reader 83. Subsequently, the collective QR label 82 having collectively recorded therein the read information (i.e., the information related to the recording heads 18), the alignment information of the recording heads 18 measured in advance where appropriate, and the arrangement information of the recording heads 18 is issued. For example, the recording heads 18*a* to 18*e* are respectively set as a first head to a fifth head in that order from the home position toward the full position, and the serial numbers of the heads, the optimal drive voltage values, the Tc ranks, the color adjust IDs, and the frequency characteristic IDs are collectively recorded in a single collective QR label 82 for the recording heads 18*a* to 18*e*. In addition, the aforementioned alignment information is preferably recorded in the collective QR label 82 in correspondence with the numbers of the recording heads 18. Then, the collective QR label 82 is bonded to the label bonding section 26*c* of the sub carriage 26.

The carriage-assembly manufacturing process involves manufacturing the carriage assembly 3. First, the head unit 17 manufactured in the aforementioned process is positionally adjusted and attached within the carriage body 12. Then, the carriage cover 13 is attached to the carriage body 12. In this case, the window 12*c* of the carriage body 12 is set in an open state without attaching the cover member 16 thereto.

Figure 19:
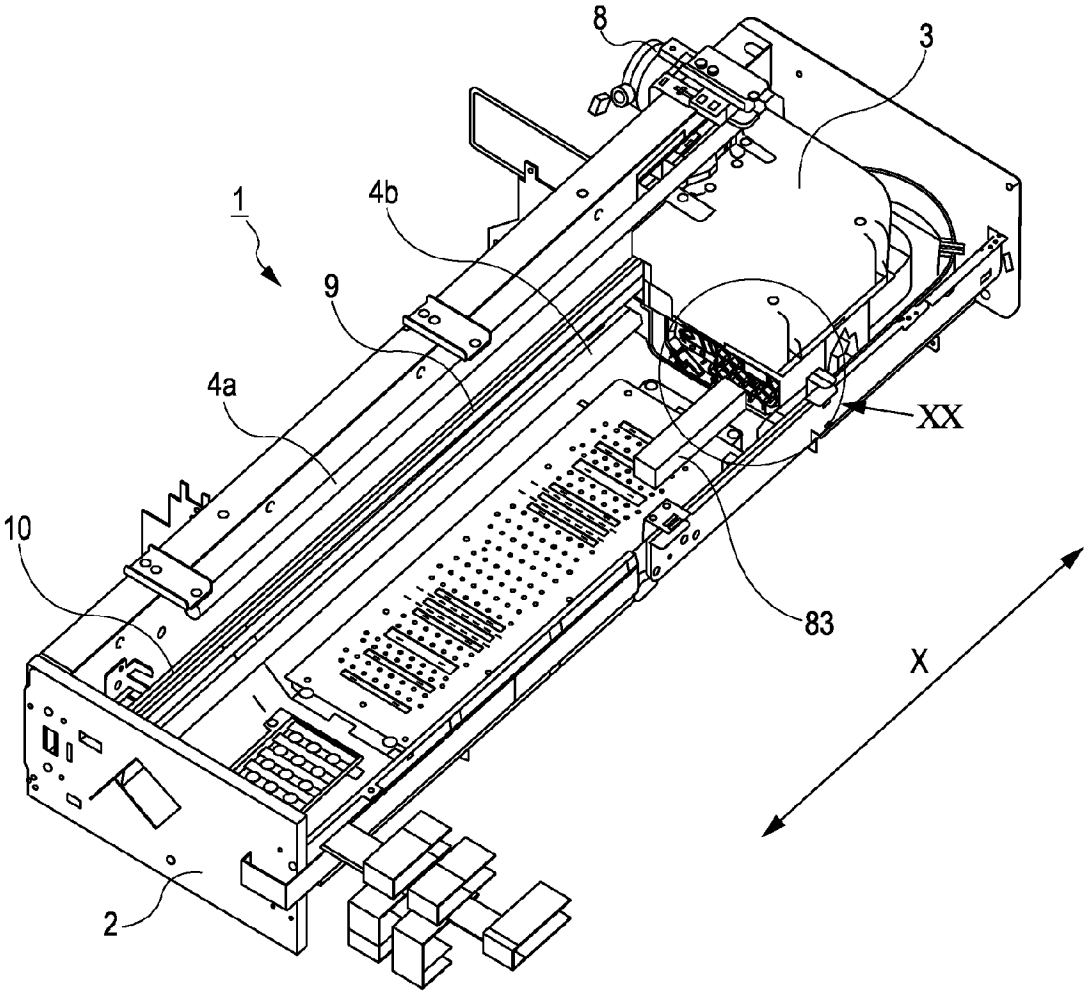
FIG. 19 is a perspective view showing a part of the internal configuration of the printer for explaining how a collective QR label is read.

The printer-body manufacturing process involves manufacturing the printer 1 by combining together components in addition to the aforementioned carriage assembly 3. First, in addition to the carriage assembly 3, components constituting the printer 1, such as the guide rods 4*a* and 4*b*, the carriage motor 8, the linear scale 10, the ink supply tubes 14, and the signal cables 15, are combined so as to form the printer 1. In this state, the QR label reader 83 is brought to face the window 12*c* of the carriage body 12 so as to read the information from the collective QR label 82 (see FIGS. 15, 19, and 20B). In this embodiment, in a state where the carriage assembly 3 is set on standby at the home position, the window 12*c* and the collective QR label 82 are provided in the sidewall 12*b* located proximate to the full position (toward the traveling direction when the carriage assembly 3 set on standby at the home position is driven), and a space is provided at a position facing the window 12*c*. Therefore, the QR label reader 83 can be readily brought close to the collective QR label 82 through the space. Consequently, the information can be readily read from the collective QR label 82. Based on this read information, an optimal drive signal is set. Specifically, based on the information related to each recording head 18, such as the Tc rank, the color adjust ID, and the frequency characteristic ID, in addition to the optimal drive voltage value for the recording head 18, the waveform of a drive pulse of the recording head 18, including the minimum electric potential VL, the maximum electric potential VH, and the expansion component p1, and the timing of the drive pulse are determined. In the case where alignment information is given to each recording head 18, the timing of the drive pulse (or a latch signal or an ejection start signal) in the drive signal may be determined in view of the alignment information in addition to the aforementioned information. For example, in the case where relative displacement of the nozzles 51 in the recording head 18*a*, serving as the first head, toward the full position is read from the information based on the nozzle-to-nozzle distance of the recording head 18*a*, when the liquid ejecting operation is to be performed by moving the carriage assembly 3 toward the full position, the drive timing of the recording head 18*a* is set at an earlier timing relative to the other recording heads 18 by an amount equivalent to the displacement. If the liquid ejecting operation is to be performed by moving the carriage assembly 3 in the opposite direction, the drive timing of the recording head 18*a* is set at a later timing relative to the other recording heads 18 by an amount equivalent to the displacement. Accordingly, optimal drive signals are set for the recording heads 18 and are stored in the controller of the printer 1.

Since there are factors other than the alignment information that can cause a variation in landing positions, such as a variation in the traveling speed of liquid droplets, it is preferable to perform a timing adjustment process after the manufacturing process of the printer 1. Specifically, this timing adjustment process involves performing recording on the ejection target object using timing adjustment values of the drive pulses based on the alignment information in the collective QR label 82, and then further adjusting the timing of the drive pulses where necessary on the basis of the recording result. In this case, with the use of the drive signals based on the alignment information, the probability of the landing positions being contained within the adjustment range (i.e., the tolerance range for the landing positions) in the first adjustment step is increased, as compared with when performing a timing adjustment process using a common drive signal shared by the recording heads 18, thereby advantageously reducing the time required for the timing adjustment process.

Accordingly, since the head unit 17 has the collective QR label 82 that collectively includes the information of the recording heads 18, the information of the recording heads 18 can be readily read, regardless of the mounting positions of the recording heads 18, by setting this collective QR label 82 in advance at a readily readable location (i.e., the label bonding section 26*c* in this embodiment). Therefore, optimal control can be performed for each recording head 18 on the basis of the read information. In other words, an optimal drive signal can be set for each recording head 18. Furthermore, since the information of each recording head 18 can be obtained by reading a single QR label, a human error, such as accidentally reading a neighboring QR label, can be prevented, thereby ensuring the correspondence relationship between the read information and the recording head 18. Moreover, in addition to the information about each recording head 18 itself, information related to the alignment in the recording head 18, such as positional displacement of the nozzles 51 in the recording head 18, can also be recorded. Therefore, by reading the information during the manufacturing process of the printer 1, more optimal control can be performed in view of the information related to the alignment in each recording head 18, in addition to the information about the recording head 18 itself. Specifically, by adjusting the ejection timing of each recording head 18 on the basis of the read alignment information, deviations in the ink landing positions on the recording medium caused by positional displacement or inclination of the nozzles 51 can be reduced. By performing the liquid ejecting operation using the drive signals set to optimal parameters, target design liquid ejection properties can be achieved. Furthermore, the cover member 16 can be attached to the window 12*c* when the collective QR label 82 is not being read, thereby protecting the head unit 17. In particular, mist created during liquid ejection can be prevented from entering the casing member. This not only prevents a state where the collective QR label 82 becomes dirty and unreadable due to the mist, but also prevents electronic components from short-circuiting due to the mist.

The invention is not limited to the above embodiment, and various modifications are permissible on the basis of the scope defined in the claims. For example, although an optimal drive voltage value for each recording head 18 is recorded in the corresponding individual QR label 81 in the above embodiment, other information related to the recording head 18, such as manufacturer information of the piezoelectric vibrators 59 used in the recording head 18, serial numbers of components such as the vibrator unit 47 and the channel unit 46, and the opening shape of the nozzles 51, may be recorded in the individual QR label 81. Moreover, these pieces of information may be recorded both in the individual QR labels 81 and the collective QR label 82, or may be recorded only in the collective QR label 82.

Furthermore, in addition to the arrangement information of the recording heads 18, the inclination of the nozzle faces 53 of the recording heads 18, the height of the nozzle faces 53 from the head-unit reference surface (i.e., reference attachment position relative to the head unit 17), and the relative position or the inclination of the nozzles 51 (i.e., the inclination of the straight portions of the nozzles 51), the collective QR label 82 may also include main factors that cause a variation in the ink landing positions in the main scanning direction X, such as liquid-droplet-amount information or information related to the liquid-droplet traveling speed. Thus, an adjustment process in the main scanning direction X can be omitted from the timing adjustment process. Specifically, an optimal timing can be calculated in advance from these pieces of information so that ink ejection control can be performed on the basis of this timing, thereby minimizing deviations in the landing positions of the ink droplets ejected onto the ejection target object from the nozzles 51. This eliminates the need for an adjustment based on the landing positions when the ink droplets are actually ejected, or shortens the time required for the adjustment. In particular, when the head unit 17 is to be replaced in the user's usage environment at the time of an after-sales service, the time period from the replacement to the adjustment can be shortened, thereby advantageously increasing the availability of the printer 1 for the user.

Furthermore, the manufacturing process of the printer 1 in the above embodiment is divided into the recording-head manufacturing process, the head-unit manufacturing process, the carriage-assembly manufacturing process, and the printer-body manufacturing process. Alternatively, for example, a printer preassembly process and an inspection process may be added between the carriage-assembly manufacturing process and the printer-body manufacturing process. In this case, the printer 1 is manufactured by performing the recording-head manufacturing process, the head-unit manufacturing process, the carriage-assembly manufacturing process, the printer preassembly process, the inspection process, and the printer-body manufacturing process. The printer preassembly process involves preassembling the printer 1. Specifically, of the components constituting the printer 1, such as the carriage assembly 3 formed in the carriage-assembly manufacturing process, the guide rods 4*a* and 4*b*, and the carriage motor 8, components that are at least required for the ink ejection operation are joined to the frame 2 of the printer 1. In this state, the QR label reader 83 is brought to face the window 12*c* of the carriage body 12 so as to read the information from the collective QR label 82. Based on this read information, optimal drive signals are set and stored in a controller of an inspection tool (not shown). Subsequently, the inspection process involves inspecting the preassembled printer 1 by performing liquid ejecting operation using the inspection tool. If the result satisfies a predetermined acceptance criterion, the inspection ends, and the signals used for the inspection are set as the drive signals. On the other hand, if there is a problem, such as the liquid not being ejected onto the ejection target object as planned, the drive signals are adjusted, and the inspection is performed again. The adjustment and the re-inspection are continuously performed until the obtained result satisfies the predetermined acceptance criterion. When the result satisfies the predetermined acceptance criterion, the inspection ends, and the drive signals are set. As described above, since optimal drive signals are set in advance on the basis of the drive voltages and the alignment information of the recording heads 18 read from the collective QR label 82, there is substantially no need to perform a readjustment process on the drive signals. Even if such a readjustment process is necessary, since the drive signals would only need to be finely adjusted, the time required for the inspection can be significantly shortened. After the inspection process, the drive signals set in the above-described manner are stored in the controller of the printer 1, and the remaining components that were not combined in the printer preassembly process, such as the signal cables 15 and the cover member 16, are joined to the printer 1, whereby the printer 1 is manufactured (printer-body manufacturing process).

Furthermore, the information to be recorded in the collective QR label 82 is not limited to a group of information recorded in the individual QR labels 81, but may include relevant information with which the contents of the information recorded in the individual QR labels 81 (i.e., specific information related to the recording heads 18, such as the optimal drive voltage values) can be ascertained. For example, the specific information related to the recording heads 18 may be stored in an additionally prepared database, and encrypted information corresponding to the aforementioned information may be recorded in the collective QR label 82. In this way, the information related to the recording heads 18 can be retrieved from the database by reading the encrypted information from the collective QR label 82. Accordingly, even if the encrypted information in the collective QR label 82 is read by a third person without permission, the information related to the recording heads 18 is prevented from leaking. In addition to the information indicating specific properties of the recording heads 18, such as the optimal drive voltage values, as mentioned above, the information related to the recording heads 18 may also include relevant information with which the contents of the aforementioned information can be ascertained.

Although the above description is directed to the ink jet printer 1 as an example of a liquid ejecting apparatus, the invention can also be applied to other types of liquid ejecting apparatuses in which recording heads are fixed to a head fixing member with an intervening member interposed therebetween. Examples of such liquid ejecting apparatuses include a display manufacturing apparatus for manufacturing color filters in a liquid crystal display, an electrode manufacturing apparatus for forming electrodes in an organic electroluminescence (EL) display or a field emission display (FED), a chip manufacturing apparatus for manufacturing biochips, and a micro-pipette for supplying a small amount of sample solution with high accuracy.

What is claimed is:

1. A liquid ejecting apparatus comprising a liquid ejecting head unit including a plurality of liquid ejecting heads in a parallel arrangement, each liquid ejecting head ejecting a liquid from nozzles formed in a nozzle face toward an ejection target object in accordance with a drive signal from a controller, wherein each of the liquid ejecting heads has an individual two-dimensional code that includes at least a portion of information related to the liquid ejecting head, and wherein the liquid ejecting head unit includes a collective two-dimensional code that includes arrangement information of the liquid ejecting heads in the liquid ejecting head unit and collective information related to the information included in the individual two-dimensional codes, the collective two-dimensional code including some information which is not included in the individual two-dimensional codes.

2. The liquid ejecting apparatus according to claim 1, wherein each of the liquid ejecting heads has a plurality of nozzle arrays provided with the nozzles, and a pressure generator that generates pressure fluctuation in the liquid within a pressure chamber communicating with the nozzles, wherein the drive signal includes a drive pulse that drives the pressure generator so as to eject the liquid from the nozzles, and wherein the information related to the liquid ejecting head includes at least one of drive voltage information of the drive pulse, natural vibration period information of pressure vibration occurring in the liquid in the pressure chamber, liquid-amount identification information indicating a variation in the amount of the liquid ejected from the nozzles in each nozzle array, and frequency characteristic information related to the amount or the traveling speed of the liquid ejected from the nozzles by repeatedly applying the drive pulse to the pressure generator.

3. The liquid ejecting apparatus according to claim 1, wherein, in addition to the arrangement information and the collective information, the collective two-dimensional code includes information related to alignment of each liquid ejecting head in the liquid ejecting head unit.

4. The liquid ejecting apparatus according to claim 3, wherein the information related to the alignment includes at least one of the inclination of the nozzle face of each liquid ejecting head in the liquid ejecting head unit, the height of the nozzle face from a head-unit reference surface, the relative position or the inclination of the nozzles, liquid-droplet-amount information, and information related to liquid-droplet traveling speed.

5. The liquid ejecting apparatus according to claim 1, further comprising a casing member accommodating the liquid ejecting head unit therein, wherein the casing member is provided with an opening that exposes the nozzle faces and a window located at a position facing the collective two-dimensional code and extending through the casing member in a thickness direction thereof, and is also provided with a detachable cover member that covers the window at a front face of the window.

6. The liquid ejecting apparatus according to claim 1, wherein a first surface on which the collective two-dimensional code is put orients in a different direction from that of a second surface on which the individual two-dimensional codes are put.

7. The liquid ejecting apparatus according to claim 1, wherein each of the collective two-dimensional code and the individual two-dimensional codes are formed as a matrix type two-dimensional code.

8. The liquid ejecting apparatus according to claim 1, wherein the information related to the liquid ejecting head includes an optimal drive voltage value, the optimum drive voltage value being determined by driving each ejection head with a plurality of different drive voltages to thereby determine the optimal drive voltage value for each liquid ejecting head.

* * * * *